US006600892B2

(12) United States Patent
Kamimura et al.

(10) Patent No.: US 6,600,892 B2
(45) Date of Patent: Jul. 29, 2003

(54) DEVELOPING DEVICE, CHARGING METHOD USED THEREFOR, AND PRINTING APPARATUS HAVING THE DEVELOPING DEVICE

(75) Inventors: Taisuke Kamimura, Kitakatsuragi (JP); Toshimitsu Goto, Yamatokoriyama (JP); Kiyoshi Toizumi, Nara (JP)

(73) Assignee: Sharp Kabushiki Kaisha (JP)

( * ) Notice: Subject to any disclaimer, the term of this patent is extended or adjusted under 35 U.S.C. 154(b) by 0 days.

(21) Appl. No.: 10/115,530

(22) Filed: Apr. 3, 2002

(65) Prior Publication Data

US 2002/0141790 A1 Oct. 3, 2002

(30) Foreign Application Priority Data

Apr. 3, 2001 (JP) ..... 2001-105267
Nov. 30, 2001 (JP) ..... 2001-366786

(51) Int. Cl.[7] ..... G03G 15/08

(52) U.S. Cl. ..... 399/281; 399/253; 399/284; 430/120

(58) Field of Search ..... 399/279, 281, 399/284, 252, 253; 430/120; 361/225

(56) References Cited

U.S. PATENT DOCUMENTS 4,522,907 A 6/1985 Mitsuhashi et al. ..... 430/102
5,637,430 A 6/1997 Shimizu et al. ..... 430/106
6,438,346 B2 * 8/2002 Kamimura et al. ..... 399/281

FOREIGN PATENT DOCUMENTS

EP 0 156 419 A2 12/1992
JP 07-281473 A 10/1995 ..... G03G/9/08
JP 8-101527 A * 4/1996

OTHER PUBLICATIONS

Copy of Jun. 27, 2002 European Search Report.

* cited by examiner

*Primary Examiner*—Joan Pendegrass
(74) *Attorney, Agent, or Firm*—Edwards & Angell, LLP; John J. Penny, Jr.; David G. Conlin

(57) ABSTRACT

A developing device includes a developing roller and a toner charging roller. The toner charging roller has (a) a metallic layer which induces its electrons by receiving light irradiation, and (b) an ultraviolet irradiater which irradiates ultraviolet to the metallic layer. The toner charging roller gives the electrons to toner, so that the toner on the developing roller is charged. There is a space between the toner charging roller and the developing roller, and a grid electrode which controls a flow of the electrons is provided in the space. Thus, mechanical/thermal load given to the toner or the toner charging roller can be reduced, so that it is possible to prevent deterioration of toner and the device.

44 Claims, 24 Drawing Sheets

C—C

DEVELOPING DEVICE, CHARGING METHOD USED THEREFOR, AND PRINTING APPARATUS HAVING THE DEVELOPING DEVICE

FIELD OF THE INVENTION

The present invention relates to a developing device used in an electrophotographic-type image forming apparatus such as a copying machine, a printer, and a facsimile, and relates to a charging method used therefor and a printing apparatus having the developing device.

BACKGROUND OF THE INVENTION

Generally, an electrophotographic-type image forming apparatus (electrophotographic apparatus) such as a copying machine, a printer, and a facsimile includes an LSU, a photoreceptor drum, and a developing device. Here, the LSU is to irradiate laser beam on a rotating photoreceptor drum, and to form an electrostatic latent image on a surface of the photoreceptor drum. Further, a developing device develops (visualizes) the electrostatic latent image by providing toner to the photoreceptor drum.

The developing device includes a developing roller which is provided so as to be adjacent and opposite to the photoreceptor drum. Further, the developing device is set to be capable of providing toner sequentially to the whole electrostatic latent image on the photoreceptor drum by providing toner to the surface of the developing roller and rotating the developing roller in a direction opposite to the photoreceptor drum.

Incidentally, in the above-mentioned developing device, toner is electrostatically absorbed in the electrostatic latent image on the photoreceptor drum, so that developing is performed. Thus, it is required to charge toner by any method.

For example, a developing device using toner of nonmagnetic 1 component system or toner of magnetic 1 component system (toner containing magnetic powder) includes a supplying roller provided opposite to the developing roller, and a layer thickness restricting blade (blade) provided on the downstream side with respect to the supplying roller (on the downstream side along a rolling direction of the developing roller).

The supplying roller supplies toner sequentially to a surface of the rotating developing roller, and the blade restricts a thickness of toner whose surface is uneven on the developing roller. Further, the blade is also charging means, and is set to give frictional charge to toner by rubbing against the toner which serves as charged means. Thus, it is possible to charge toner used to develop images.

A developing device using developer of 2 component system, in which carrier is mixed with toner, is arranged so that toner and carrier are stirred and mixed in a toner tank, and friction which occurs between them gives frictional charge to the toner as in the foregoing manner. In this case, the carrier serves as the charging means.

However, according to the arrangement in which friction against the blade (mechanical friction) charges toner, it is required to enlarge speed difference between the toner and the blade so as to obtain a sufficient amount of charge. While, mechanical/thermal load is given to the toner and the blade in proportion to the speed difference.

Thus, if the speed difference is enlarged so as to obtain the sufficient amount of charge, the mechanical/thermal load given to the toner and the blade becomes large, so that there occurs such a problem that toner is damaged or deteriorated. Moreover, this arrangement has the following defect: toner which has been softened by frictional heat is fused and adheres to the blade or the developing roller, so that charging property of toner deteriorates and the developing device becomes out of order.

Also in the arrangement in which toner is charged by the friction against the carrier, in order to obtain the sufficient amount of charge, it is required to stir the toner and the blade at a high speed so as to enlarge the speed difference as in the arrangement in which the blade is used. Thus, excessive mechanical/thermal load is given to the toner and the carrier, so that this raises such a problem that toner/carrier is damaged or deteriorated. Moreover, this arrangement has the following defect: toner which has been softened by frictional heat is fused and adheres to the blade or the developing roller, so that charging property of toner deteriorates.

In the developing device using the method which causes toner to come into contact with the charging means such as blade/carrier with a large speed difference maintained (contact charging method), mechanical/thermal load given to the charging means such as toner, and blade/carrier is large.

In particular, toner which requires less fixing energy in accordance with reduction in a softening point of toner, or has higher coloring performance in accordance with increase in a pigment amount of toner (damage-proof property of toner is lowered) has been being improved as an energy-saving technique recently. However, since the conventional friction-charging method gives mechanical/thermal load to toner as described above, it is impossible to apply the method to the above-mentioned toner.

SUMMARY OF THE INVENTION

The object of the present invention is to provide (a) a developing device which can reduce mechanical/thermal load given to toner and toner charging means for charging the toner so as to prevent deterioration of toner and the device, (b) a charging method used therefore, and (c) a printing apparatus having the developing device.

Alternately, the object of the present invention is to provide a developing device which can prevent toner from deteriorating, that is, from being damaged and from adhering to a blade so as to improve reliability in developing images, and is particularly to provide (a) toner whose softening point is lowered so as to reduce a fixing energy and (b) a developing device which can be applied to toner whose pigment amount is increased so as to heighten the coloring performance.

In order to achieve the foregoing object, a developing device of the present invention, which is used in an electrophotographic apparatus to develop an electrostatic latent image on a latent image support body by developer that has been charged, includes: transport means for supporting the developer so as to transport the developer to the latent image support body; and charging means which includes (a) an electron inducing section for inducing its electrons by receiving light irradiation and (b) irradiating means for irradiating light to the electron inducing section, and gives the electrons to the developer so as to charge the developer, wherein the charging means and the transport means have a space therebetween, and a grid electrode for controlling a flow of the electrons is provided in the space.

According to the foregoing arrangement, the charging means and the transport means have a space therebetween, so that developer and the charging means are not in contact with each other while having a great speed difference when the developer being transported is charged. Thus, mechanical/thermal load given to the developer and the charging means can be restricted. Thus, it is possible to prevent developer from deteriorating (from being damaged) and the device from deteriorating. Further, it is possible to prevent deterioration in charging property of developer which is brought about since developer softened by frictional heat between the charging means and the transport means adheres to the charging means or the transport means.

Further, the grid electrode is provided, so that it is possible to control a flow of electrons flowing from the charging means to the transport means. Thus, it is possible to restrict dispersion of the charging amount with respect to developer, so that it is possible to stabilize a surface potential of developer at a desired value. Thus, reliability of the developing device can be improved.

Alternately, in order to achieve the foregoing object, the developing device of the present invention, which is used in an electrophotographic apparatus to develop an electrostatic latent image on a latent image support body by developer that has been charged, includes: a developer support body for supporting the developer so as to transport the developer to the latent image support body; and developer charging means for charging the developer, wherein the developer charging means is provided so as to be separated from the developer support body and is provided with an electron emitting section which can emit electrons toward the developer which is to be charged, and the developer charging means charges the developer by sprinkling the electrons, that have been emitted from the electron emitting section, over the developer.

According to the foregoing arrangement, in the developing device, developer can be charged by the developer charging means. In this case, it is not necessary that a layer thickness restricting blade, which restricts a layer thickness of toner provided on the developer support body as a layer, has both functions: (a) a toner-layer-thickness restricting function and (b) a toner charging function, but the layer thickness restricting blade can specialize in the toner-layer-thickness restricting function.

Further, the developer charging means is provided so as to be separated from the developer support body, and the developer charging means charges the developer by sprinkling the electrons, that have been emitted from the electron emitting section, over the developer. That is, the developer charging means can charge developer without giving any load to the developer.

Thus, in the developing device, it is possible to largely reduce pressure of the layer thickness restricting blade exerted on the developer support body compared with a conventional layer thickness restricting blade, so that load (mechanical load and thermal load) exerted on the developer is reduced. Thus, it is possible to prevent developer from being damaged and from adhering.

For a fuller understanding of the nature and advantages of the invention, reference should be made to the ensuing detailed description taken in conjunction with the accompanying drawings.

DESCRIPTION OF THE EMBODIMENT

[Embodiment 1]

One embodiment of the present invention is described based on drawings as follows.

Figure 1:
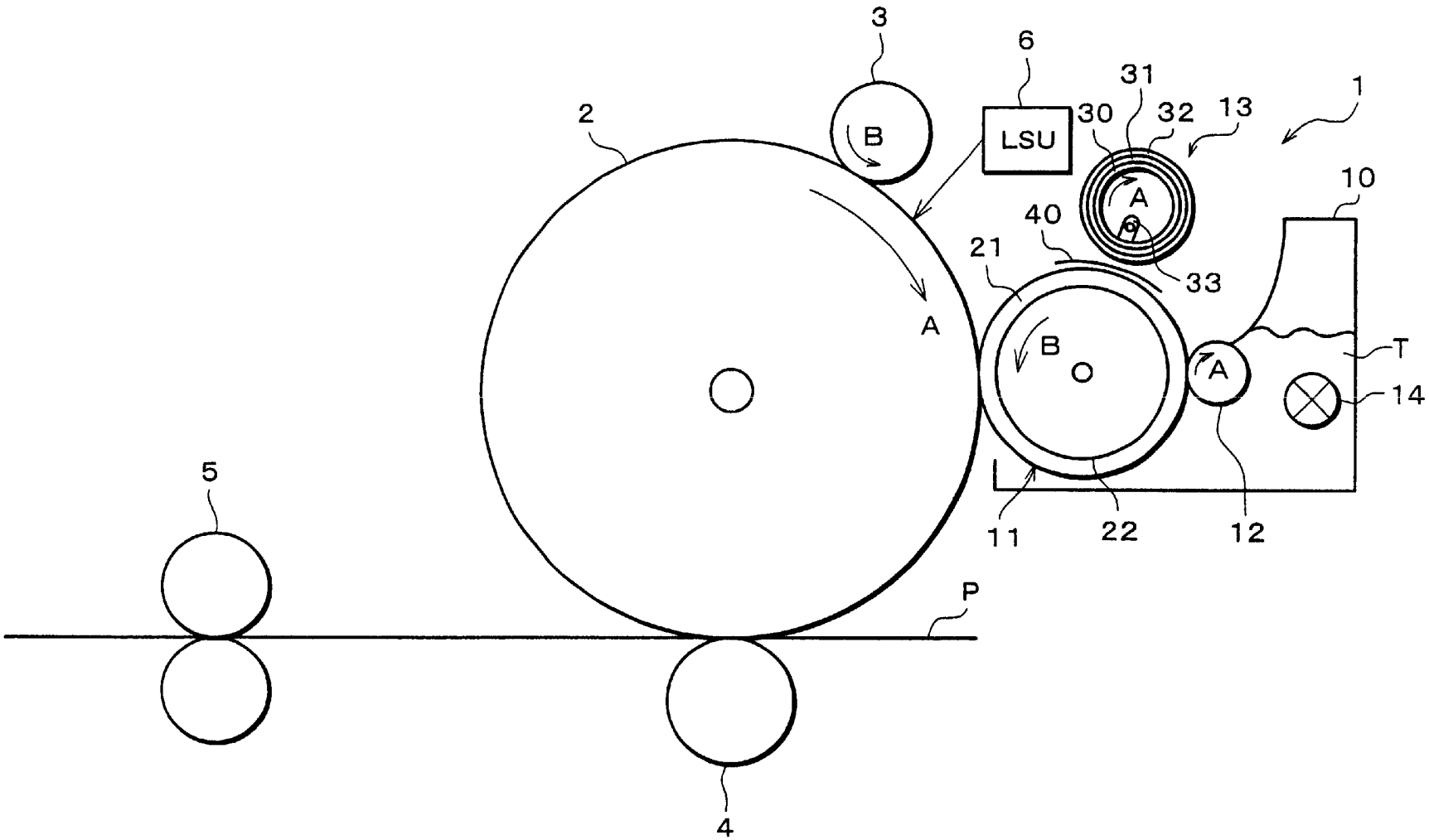
FIG. 1 is an explanatory drawing showing an arrangement of a printing apparatus according to Embodiment 1 of the present invention.

FIG. 1 is an explanatory drawing showing an arrangement of a printing apparatus according to the present embodiment. The printing apparatus according to the present embodiment, as shown in FIG. 1, includes: a developing section (developing device) 1; a photoreceptor drum 2; a charging roller 3; a transcription roller 4; a pair of fixing rollers 5; and an LSU (laser beam scanner unit) 6. Further, this has an arrangement in which nonmagnetic toner of 1 component system is used.

The photoreceptor drum 2 has a photoreceptor on its surface, and has a drum-shaped body. The photoreceptor drum 2 is driven so as to rotate in an A-direction at a speed of 50 to 150 mm/s.

The charging roller 3 uniformly charges a surface of the photoreceptor drum 2 at a predetermined potential. The charging roller 3 is driven so as to rotate in a B-direction (direction opposite to the A-direction) at the same speed as the photoreceptor drum 2.

The LSU (laser beam scanner unit) 6 exposes a surface of the charged photoreceptor drum 2 by laser beam (an arrow of FIG. 1). Further, the LSU has a function for forming a electrostatic latent image, corresponding to image data inputted from the outside, on the surface of the photoreceptor drum 2.

The developing section 1 forms a toner image on the photoreceptor drum 2 by developing the electrostatic latent image formed by the LSU. The developing section 1 will be detailed later.

In this manner, the surface of the photoreceptor drum 2, which has been uniformly charged at a predetermined potential by the LSU 6, is exposed by laser beam directed from the LSU 6. Thus, an electrostatic latent image, corresponding to image data (image signal) inputted from the outside, is formed on the surface of the photoreceptor drum 2. Then, the developing roller 11 (described later) in the developing section 1 causes toner to adhere to the electrostatic latent image formed on the photoreceptor drum 2, so that the electrostatic latent image is developed into a toner image.

The transcription roller 4 transcribes the toner image formed on the photoreceptor drum 2 on a sheet P.

The pair of fixing roller 5 heats and presses the sheet P on which the toner image has been transcribed, so that the toner image is fixed on the sheet P by heat.

Next, description will be given as to the developing section 1 which is a characteristic arrangement in the printing device according to the present embodiment.

As shown in FIG. 1, the developing section includes: a developing tank 10; a developing roller (transport means) 11; a toner supplying roller (supplying means) 12; a toner charging roller (charging means) 13; a stirring roller 14; and a grid electrode 40.

The developer tank 10 is a container (toner tank) for storing toner T.

By stirring the toner T stored in the developer tank 10, the stirring roller 14 transports the toner T to the vicinity of the toner supplying roller 12, under a condition that coagulation of the toner T is resolved, that is, under a condition that no load is given to the toner T.

The developing roller 11 has a cylindrical body in which a base cylinder 22 made of Al (aluminium) is provided with a rubber layer 21 made of conductive rubber elastic material. Further, the developing roller 11 is a roller provided opposite to the photoreceptor drum 2, and is driven so as to rotate in a B-direction (direction opposite to the photoreceptor drum 2) at a speed of 50 to 150 mm/s (the same speed as the photoreceptor drum 2) so that the developing roller 11 is in contact with the photoreceptor drum 2, with the toner supported on a surface of the developing roller 11. Thus, the toner T can adhere to the electrostatic latent image formed on the photoreceptor drum 2, so that it is possible to develop the electrostatic latent image into a toner image.

The toner supplying roller 12 is a roller constituted of cylinder-shaped foaming rubber elastic material. Further, the toner supplying roller 12 is provided opposite to the developing roller 11 in the developer tank 10. A predetermined bias voltage is applied to the toner supplying roller 12, and the toner supplying roller 12 can absorb and support the toner T. The toner supplying roller 12 is in contact with the developing roller 11 while rotating in a direction (A-direction) opposite to a rotating direction (B-direction) of the developing roller 11 at the same speed as the developing roller 11 with the toner T supported on a surface of the toner supplying roller 12. Thus, the toner T stored in the developer tank 10 is supplied to an outer surface of the developing roller 11. Hereinbelow, a layer in which the outer surface of the developing roller 11 is covered by the toner is referred to as a toner layer. Here, the toner supplying roller 12 supplies the toner T to the developing roller 11 while rotating, so that it is possible to uniform a thickness of the toner layer (make a thickness of the toner layer even). That is, the toner supplying roller 12 also has a function for restricting a thickness of the toner layer.

The toner charging roller 13 is provided opposite to the toner supplying roller 12 with the grid electrode 40 therebetween.

The toner charging roller 13 is oppositely provided, along a rotating direction (B-direction) of the developing roller 11, on the downstream side with respect to the toner supplying roller 12, and on the upstream side with respect to the photoreceptor drum 2. Further, the toner charging roller 13 is a roller, and rotates at a constant speed in a direction opposite to the developing roller 11 (A-direction).

Figure 2:
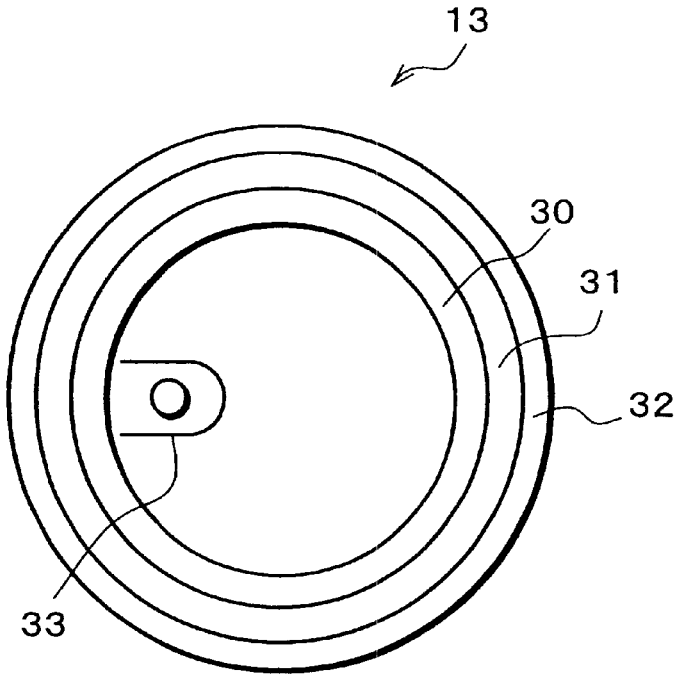
FIG. 2 is a detail drawing showing an arrangement of a toner charging roller.

The toner charging roller 13, as shown in FIG. 2, has an arrangement in which an ITO layer 31 and a metallic layer 32 are formed on a base roller 30, and ultraviolet irradiater (irradiating means) 33 is provided in the base roller 30.

The ultraviolet irradiater 33 is an ultraviolet lamp (mercury lamp of low pressure), and is a light source which irradiates ultraviolet from the inside of the base roller 30 toward the outside. The ultraviolet is irradiated to the toner layer, and this causes the toner on the developing roller 11 to be charged.

The base roller 30 is a cylindrical roller made of fused quarts having ultraviolet transmission property or transparent acrylate resin.

The ITO 31 is an electrode made of conductive ITO (Indium-Tin-Oxide) through which ultraviolet can transmit, and is provided on the base roller 30. Further, a bias voltage of −900V to −1500V is applied between the ITO layer 31 and the developing roller 11 depending on a rotation speed of the photoreceptor drum 2.

The metallic layer (electron inducting section) 32 is formed on the ITO layer 31, and receives ultraviolet irradiated from the ultraviolet irradiater 33, so that the metallic layer 32 emits electrons (photoelectrons) in accordance with photoeffect. Further, the metallic layer 32 is made of semiconductor or metal such as aluminium (Al).

Note that, as long as material having photoeffect (electrons inductive material) is used, material for the metallic layer 32 is not particularly limited. Further, titanium oxide used as photocatalyst may be used as material for the metallic layer 32.

As described above, the toner supplying roller 12 has a function for restricting a thickness of the toner layer, and uniforms the thickness of the toner layer on the developing roller, so that it is possible to charge the toner in the toner tank without fail. Thus, it is possible to prevent dispersion of the charging amount of the toner, so that it is possible to improve charging performance with respect to the toner. As a result, reliability of the developing section 1 can be improved.

Operations of the developing section 1 is described as follows.

When developing is commenced, the toner supplying roller 12 forms toner layer sequentially along a circumferential direction. Thereafter, a toner layer on the developing roller 11 is transported between the developing roller 11 and the toner charging roller 13. Further, the toner charging roller 13 gives electrons emitted from the metallic layer 32 to the toner, so that the toner is charged by photoelectron.

Thereafter, the charged toner is sent to a portion opposite to the photoreceptor drum 2, and is electrostatically absorbed in (supplied to) an electrostatic latent image formed on the photoreceptor drum 2. Thus, the electrostatic latent image is developed (visualized) as a toner image.

Next, photoelectron charge performed by the toner charging roller 13 is described.

In the toner charging roller 13, the ultraviolet irradiater 33 irradiates ultraviolet, so that electrons e are induced and emitted from the metallic layer 32 to the outside in accordance with photoeffect.

A bias voltage of −900V to −1500V is applied between the ITO layer 31 and the developing roller 11. Thus, the electrons e induced from the metallic layer 32 are accelerated toward the developing roller 11, in accordance with the bias voltage, while bringing about electrons multiplication between rollers 12 and 13 due to electron avalanche. Further, an amount of electrons e which arrive at the toner on the developing roller 11 is adjusted (flow of the electrons e is controlled) in the grid electrode 40 (described later). Thereafter, only the predetermined number of electrons e on the developing roller 11 arrive at the toner.

Due to the electrons e, the toner is charged to more than −5 $\mu$C/g which is a desired charging amount, and more preferably, the toner is charged to more than −10 $\mu$C/g. Further, due to the electrons e, the toner layer is charged to less than −30 $\mu$C/g which is a desired charging amount, and more preferably, the toner layer is charged to less than −20 $\mu$C/g.

In the case where the charging amount of the toner is more than −5 $\mu$C/g, the toner can adhere to the developing roller 11 upon transporting the toner on the developing roller 11, so that it is possible to prevent splash of the toner being transported. Further, the toner can adhere to the photoreceptor drum 2 upon developing an electrostatic latent image on the photoreceptor drum 2, so that it is possible to prevent deterioration of printing density, for example, in the case where the developing section 1 is provided in the printing apparatus.

While, in the case where the charging amount of the toner is less than −30 $\mu$C/g, the toner does not adhere to the photoreceptor drum 2 excessively upon developing an electrostatic latent image on the photoreceptor drum 2. Thus, for example, in the case where the developing section 1 is provided in the printing apparatus, it is possible to prevent rise in the printing density and occurrence of fog in printing. As described above, the charging amount of −5 $\mu$C/g to −30 $\mu$C/g is suitable to develop images by using developer. Thus, it is possible to improve reliability of the developing section 1.

Here, photoeffect is described. Electrons that exist on a surface of a metal or a semiconductor (surface electrons) are induced/emitted to the outside by receiving energy that is more than a predetermined value (work function) from the outside. Then, the photoeffect is a phenomenon in which the above-mentioned energy is given to the surface electrons by irradiation of light, and the surface electrons are emitted as electrons.

Figure 3:
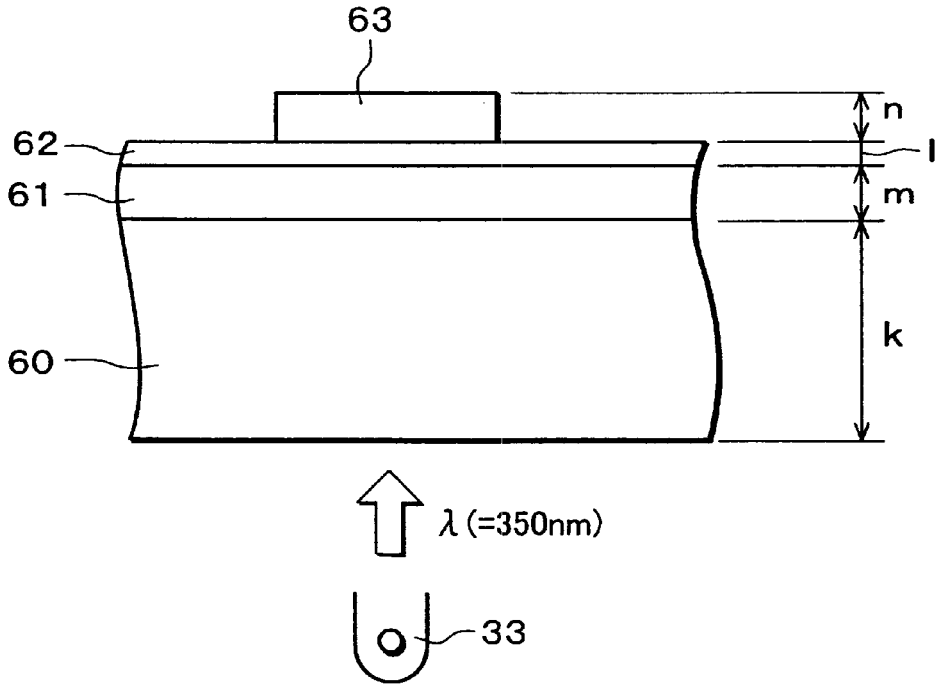
FIG. 3 is an explanatory drawing showing an example of a photoelectron charging test.

An example of the photoelectron charging used in the developing section 1 is described. Here, the following description based on FIG. 3 is to describe an example of an experiment performed with respect to photoelectron charging in which electrons are induced from the toner charging roller 13 in accordance with irradiation of ultraviolet.

First, a plate was manufactured as a virtual toner charging roller 13. The plate, first, was formed by performing vacuum deposition of an ITO 61 and a semiconductor 62 made of GaAs in this order with respect to a surface of a transparent acrylate plate 60. Further, instead of toner T, a PES 63 of polyester resin, a material of which toner is made, was placed on the plate as a charged member.

Here, a thickness k of the transparent acrylate plate 60 was 1 to 5 mm, and a thickness m of the ITO 61 was dozens nm, and a thickness 1 of the semiconductor 62 was dozens nm, and a thickness n of the PES 63 was 10 to 100 $\mu$m.

Thereafter, an ultraviolet irradiater 33 irradiated ultraviolet whose wave $\lambda$ was 350 nm from a side of a surface opposite to a surface having the PES (polyether sulfone) 63 on the plate. At this time, irradiation energy was 0.1 to 10 mW/cm2, and irradiation time was several seconds.

This realized charging −150 to −30V with respect to the surface of the PES 63. This means that toner can be charged even in a state in which there is no speed difference between toner which is a charged member and the toner charging roller 13 which is a charging member.

An electron avalanche is described as follows. That is, electrons which have been induced from the metallic layer 32 and accelerated by a bias voltage collide with gaseous molecules ($O_2$, $N_2$ etc.) in air between the toner charging roller 13 and the developing roller 11, and are dissociated, and dissociated electrons are emitted. Further, the new electrons brought about by the dissociation are accelerated by a bias voltage so as to dissociate other electrons, so that new dissociated electrons are emitted. Such increase of electrons is electron avalanche.

When the electron avalanche is used in this manner, it is possible to perform the following operation: electrons brought about by the photoeffect are accelerated by a bias voltage and collide with gaseous molecules in air, and new electrons are brought about by dissociating the foregoing electrons so as to make the new electrons participate in the dissociating operation sequentially. Further, an ultraviolet irradiating strength and an applied voltage are determined by regarding the number of electrons increased in accordance with the electron avalanche as a desired value.

As described above, the toner charging roller 13 is not in contact with the developing roller 11, and rotates at the same speed as the developing roller 11, and charges the toner layer on the developing roller 11 to a predetermined voltage value. Thus, in the metallic layer 32, an area which receives light irradiated by the ultraviolet irradiater 33 and induces electrons given to the toner is not always fixed, but moves with rotation of the toner charging roller 13. Thus, light can be irradiated to a refreshed surface, and it is possible to reduce an amount of irradiated light while promoting the occurrence of the electrons.

The metallic layer 32 is made of semiconductor or metal, so that the metallic layer 32 can easily emit electrons (has photoeffect). Therefore, since electrons induced by light irradiation can be directly given to the toner, it is possible to charge the toner easily. Thus, even when there is a space between the developing roller 11 and the toner charging roller 13, it is possible to charge the toner on the developing roller 11.

Note that, it is preferable that a distance between the toner charging roller 13 and the grid electrode 40 is 50 to 500 $\mu$m, and a distance between the grid electrode 40 and the developing roller 11 is 50 to 500 $\mu$m.

Further, there is a space between the developing roller 11 and the toner charging roller 13, so that the toner and the toner charging roller 13 are not in contact with each other while having a large speed difference upon charging the toner on the developing roller 11. Thus, it is possible to restrict mechanical/thermal load given to the toner and the toner charging roller 13. This prevents deterioration of the toner (damage given to the toner) and deterioration of the device. Further, toner which has been softened by frictional heat brought about between the developing roller 11 and the toner charging roller 13 is fused and adheres to the developing roller 11 or the toner charging roller 13, so that it is possible to prevent deterioration in a charging characteristic of the toner.

Although toner of 1 component system is charged by photoelectron charging in this manner, as a method for charging toner, toner containing a P compound may be used. In this method, a chemical structure of the P compound is changed by irradiating light to toner stored in the developer tank, so as to make the P compound in a free radical state. Then, electrons of the toner are pulled out by the P compound in the free radical state, so that the toner is charged (+charge).

However, since the toner needs to contain the P compound in this method, typical toner cannot be used, so that this raises such a problem that running cost becomes large. Further, in this method, it is required to increase an amount of the P compound so as to charge the toner quickly and sufficiently, but the increase of the P compound, a crystallized material, reduces density (masking rate) of a toner image obtained by developing, and makes toner weak so as to cause crash of toner.

The grid electrode 40 is described as follows.

Figure 4:
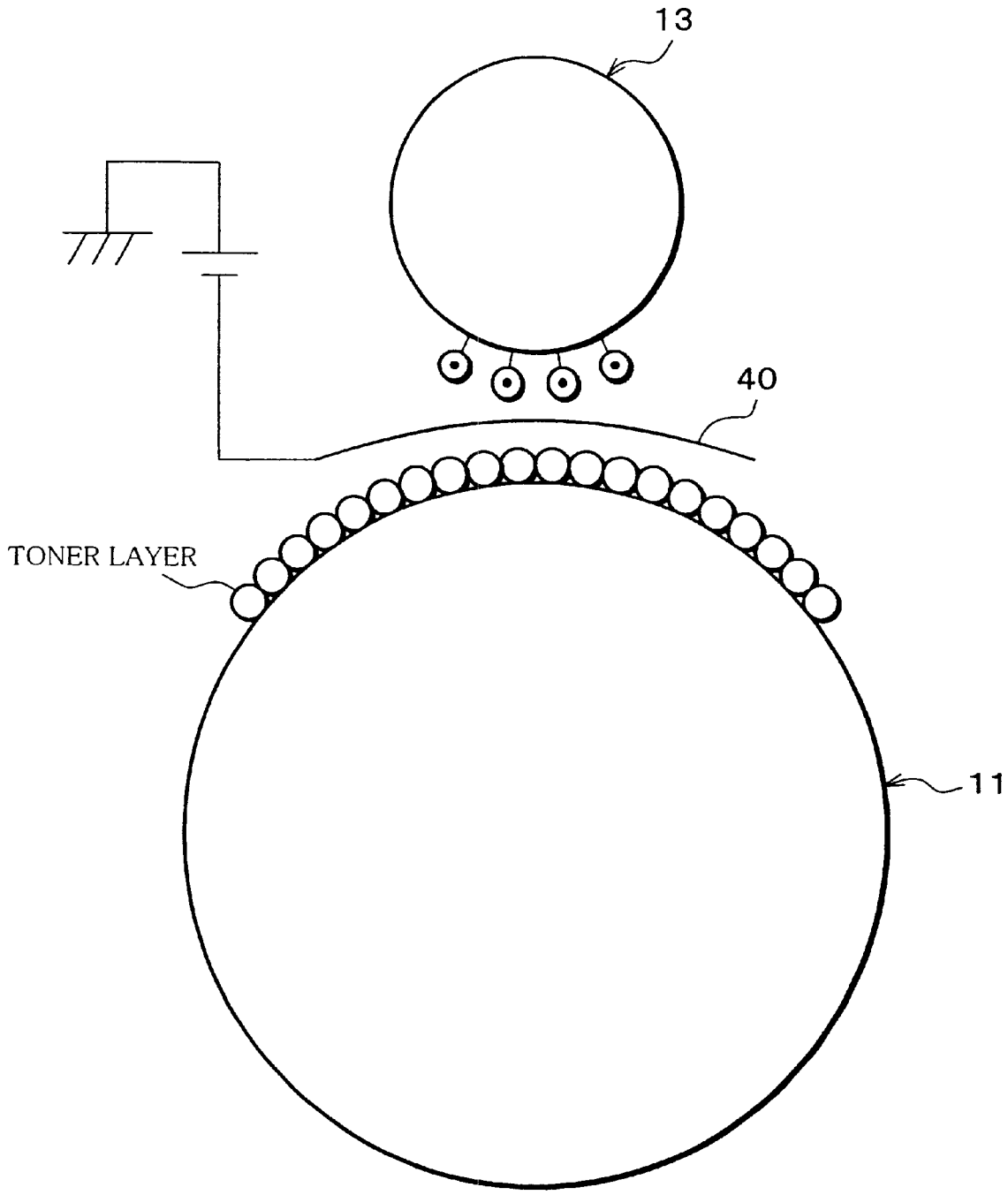
FIG. 4 is an explanatory drawing showing how a developing roller, the toner charging roller, and a grid electrode are arranged.
Figure 5:
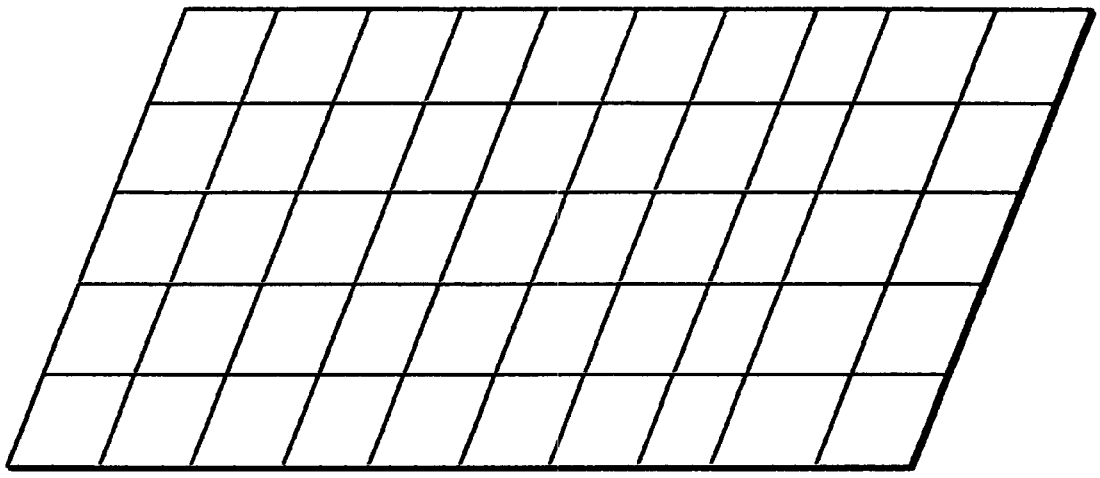
FIG. 5 is a detail drawing showing a shape of the grid electrode.

The grid electrode 40, as shown in FIG. 4, is provided between the developing roller 11 and the toner charging roller 13, and controls a flow of electrons e flowing from the toner charging roller 13. Further, its shape, as shown in FIG. 5, is mesh.

Figure 6:
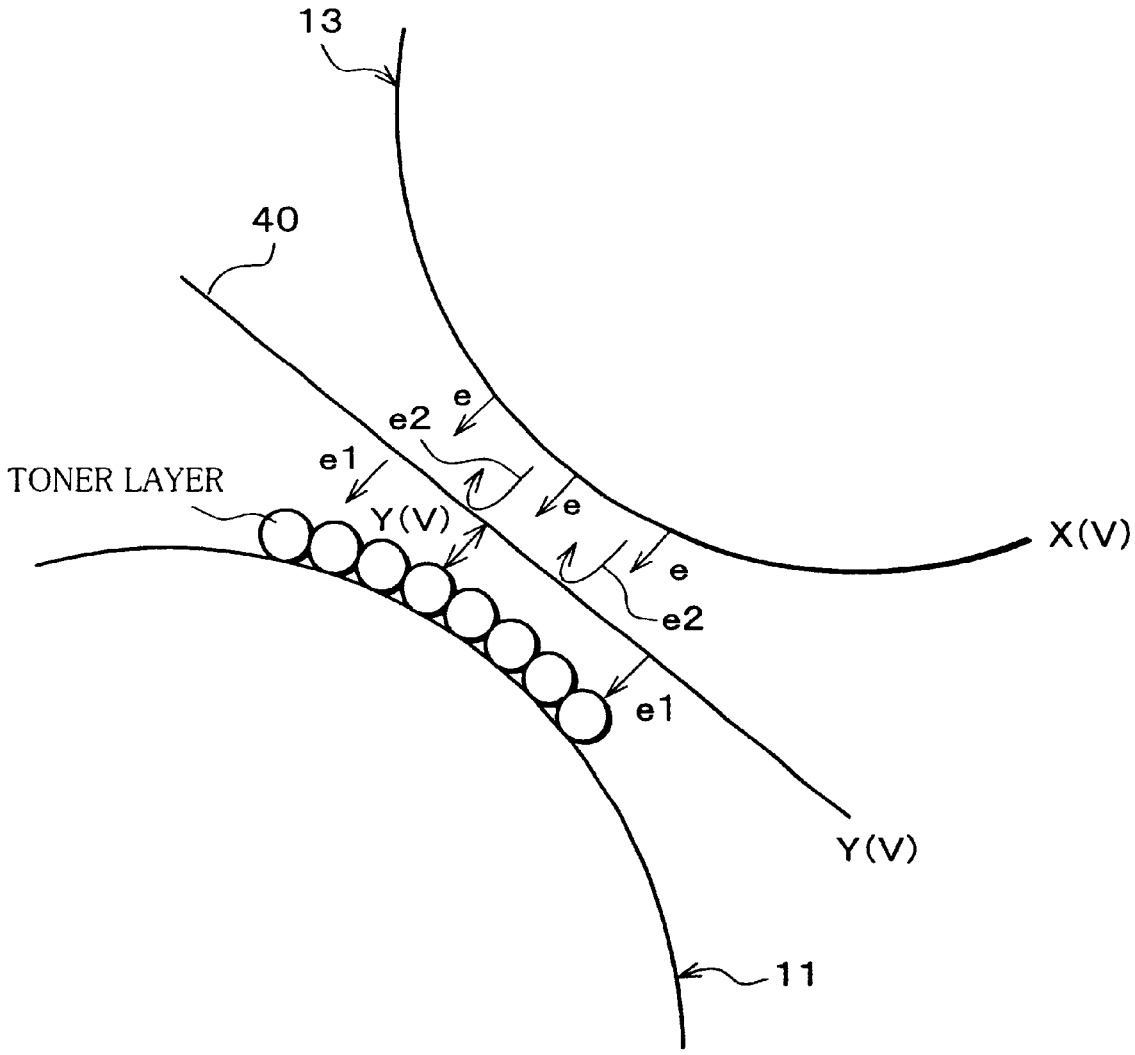
FIG. 6 is an explanatory drawing showing how the grid electrode controls a flow of electrons.

First, how the flow of electrons e is controlled by the grid electrode 40 is described based on FIG. 6.

As shown in FIG. 6, the grid electrode 40 is provided between the developing roller 11 and the toner charging roller 13. Further, a voltage of X(V) is applied to the toner charging roller 13, and a voltage of Y(V)(grid voltage) is applied to the grid electrode 40. A relationship between an absolute value of X and an absolute value of Y is $|X|>|Y|$.

An absolute value of a voltage applied to the toner charging roller 13 is made larger than an absolute value of a voltage applied to the grid electrode 40, so that electrons which have jumped out of the metallic layer 32 of the toner charging roller 13 can be emitted from the grid electrode 40 to toner on the developing roller 11.

The grid electrode 40 emits the electrons e that have jumped out of the toner charging roller 13 until toner's potential which exists on a portion (surface of the developing roller 11) opposite to the toner charging roller 13 (hereinbelow, referred to as surface potential) becomes Y(V). Here, electrons e emitted to the side of toner is referred to as e1.

While, when the surface potential of the toner layer becomes Y(V), the electrons e are restricted so as not to jump out to a side of the developing roller 11. Here, electrons e, which are restricted by the grid electrode 40 and cannot go out from the grid electrode 40 to the side of the developing roller 11, are referred to as e2.

In this manner, the grid electrode 40 restricts a flow of electrons flowing from the toner charging roller 13 to the developing roller 11. Thus, the surface potential of the toner layer is stabilized, so it is possible to restrict dispersion of the charging amount in the toner layer. As a result, charging with respect to the toner layer can be stabilized, so that it is possible to improve reliability of the developing section 1.

Figure 7:
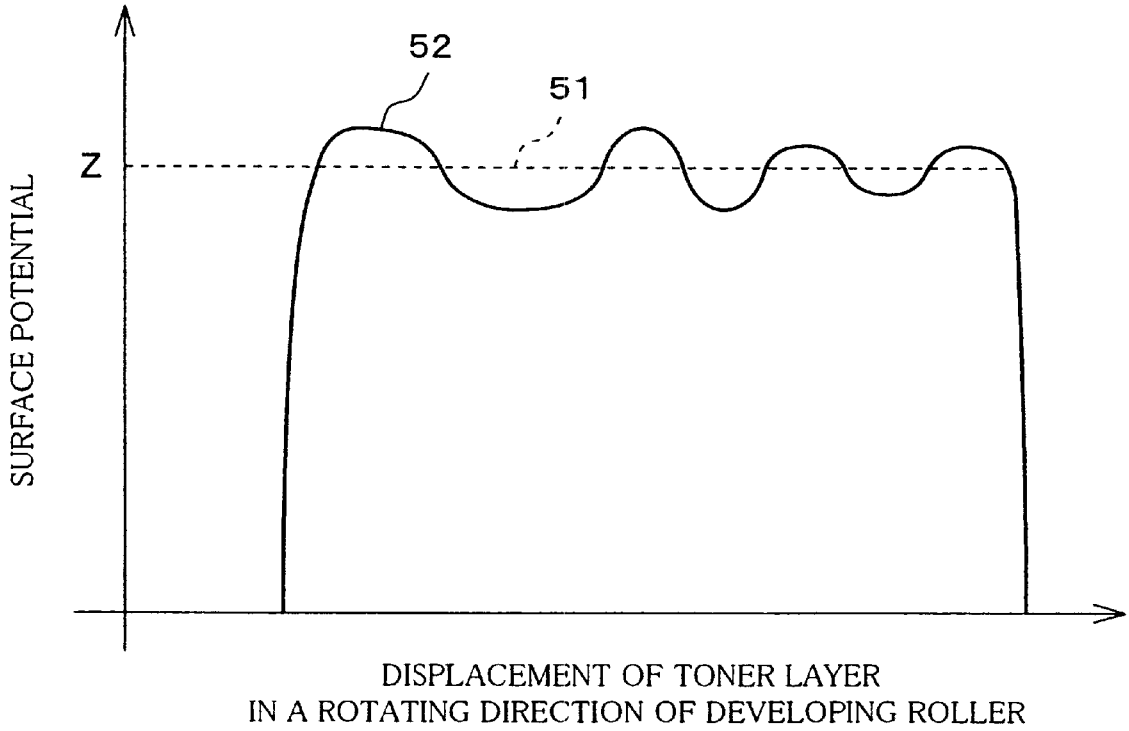
FIG. 7 is a graph showing how displacement in a rotating direction of the developing roller relates to a surface potential of toner in a toner layer.

Next, based on FIG. 7, comparatione will be performed between a surface potential in the case where the grid electrode 40 is provided between the developing roller 11 and the toner charging roller 13 and a surface potential in the case where the grid electrode 40 is not provided. FIG. 7 is a graph showing a relationship between displacement of the toner layer brought about in a rotating direction of the developing roller 11 and the surface potential of the toner layer. Further, the grid electrode 40 controls a flow of electrons e so that the surface potential of the toner is Z.

As shown in FIG. 7, in the case where the grid electrode 40 is provided, as shown by the dotted line 51, the surface potential is stabilized at Z. While, as shown by the continuous line 52, in the case where the grid electrode 40 is not provided, material of which toner is made and deflection of a voltage applied to the toner charging roller 13 cause the surface potential of the toner layer to be unstable with respect to Z.

Figure 8:
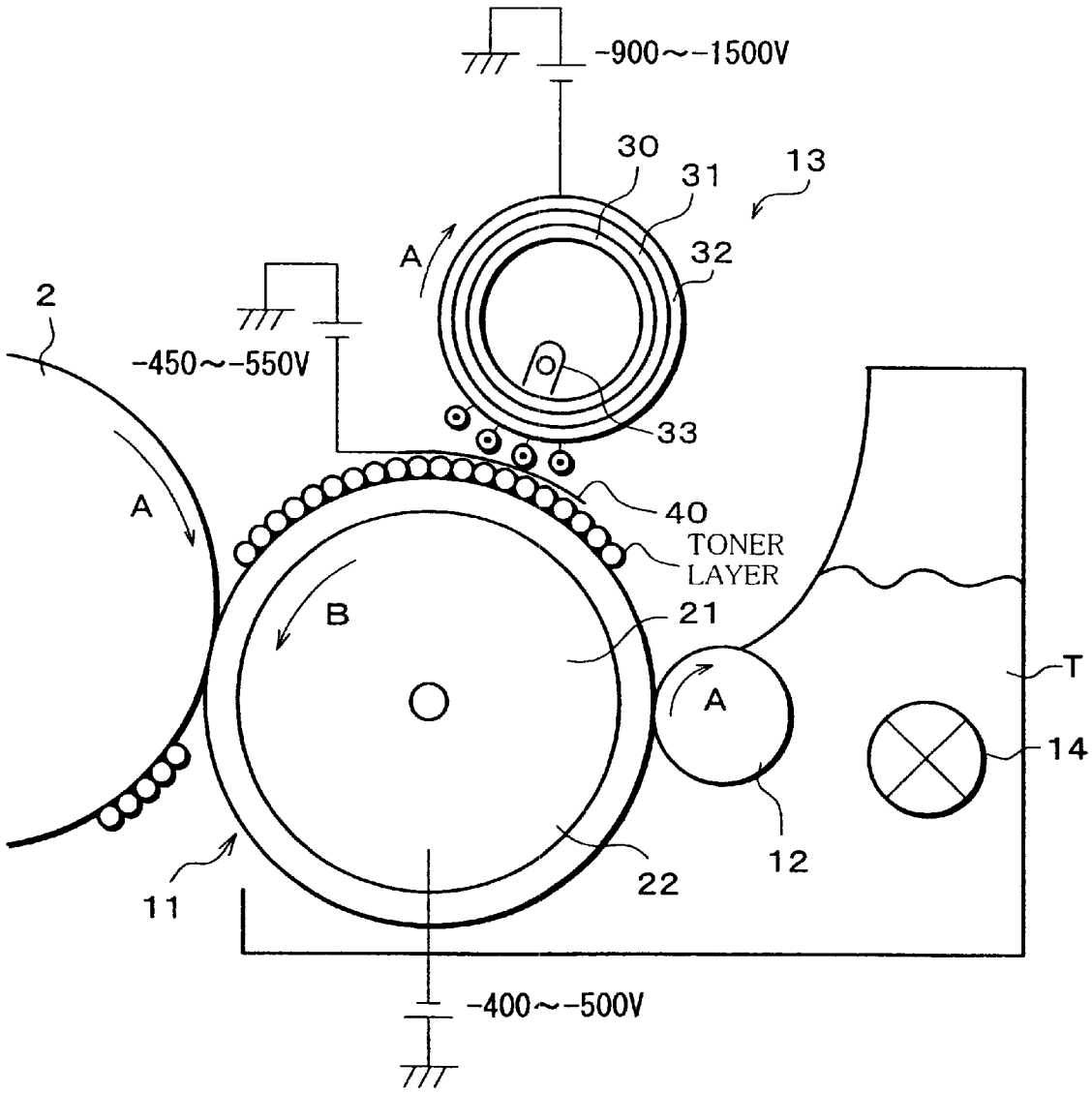
FIG. 8 is an explanatory drawing showing a voltage applied to a developing section.

Further, as shown in FIG. 8, a voltage applied to the toner charging roller 13 is −900 to −1500V, and a voltage applied to the developing roller 11 is −400 to −500V. In this case, in order to make the charging amount of the toner layer, for example, −10 $\mu$C/g to −20 $\mu$C/g which is suitable to develop images, a voltage of −50V is required. Thus, it is necessary to make the surface potential of the toner layer −450 to −550V.

While, a voltage whose potential is the same as the surface potential of the toner layer is applied to the grid electrode 40. Then, in order to make the surface potential of the toner layer −450 to −550V, the grid voltage is also made −450 to −550V. That is, a value of the grid voltage is the same as a value of the surface potential of the toner layer, so that a voltage whose potential is the same as a desired surface potential is applied to the grid electrode 40. By providing the grid electrode 40 in this manner, it is possible to make the charging amount of toner a desired value.

In this manner, an absolute value of a voltage applied to the grid electrode 40 is larger than an absolute value of a voltage applied to the developing roller 11. Thus, it is possible to charge toner of the toner layer with a voltage whose value is equal to difference between a voltage applied to the grid electrode 40 and a voltage applied to the developing roller 11.

A voltage, whose value is equal to a total value of (a) a value of a voltage for charging the toner layer and (b) a value of a voltage applied to the developing roller 11, is applied to the grid electrode 40, so that it is possible to charge toner of the toner layer with a voltage whose value is equal to difference between a voltage applied to the grid electrode 40 and a voltage applied to the developing roller 11. Thus, it is possible to stabilize the surface potential of the toner layer at a desired value.

Note that, the above-mentioned developing section 1 is not limited to a printing apparatus, and it is possible to apply the developing section 1 to an electrophotographic-type image forming apparatus (electrophotographic apparatus) such as a copying machine, a printer, and a facsimile.

Figure 9:
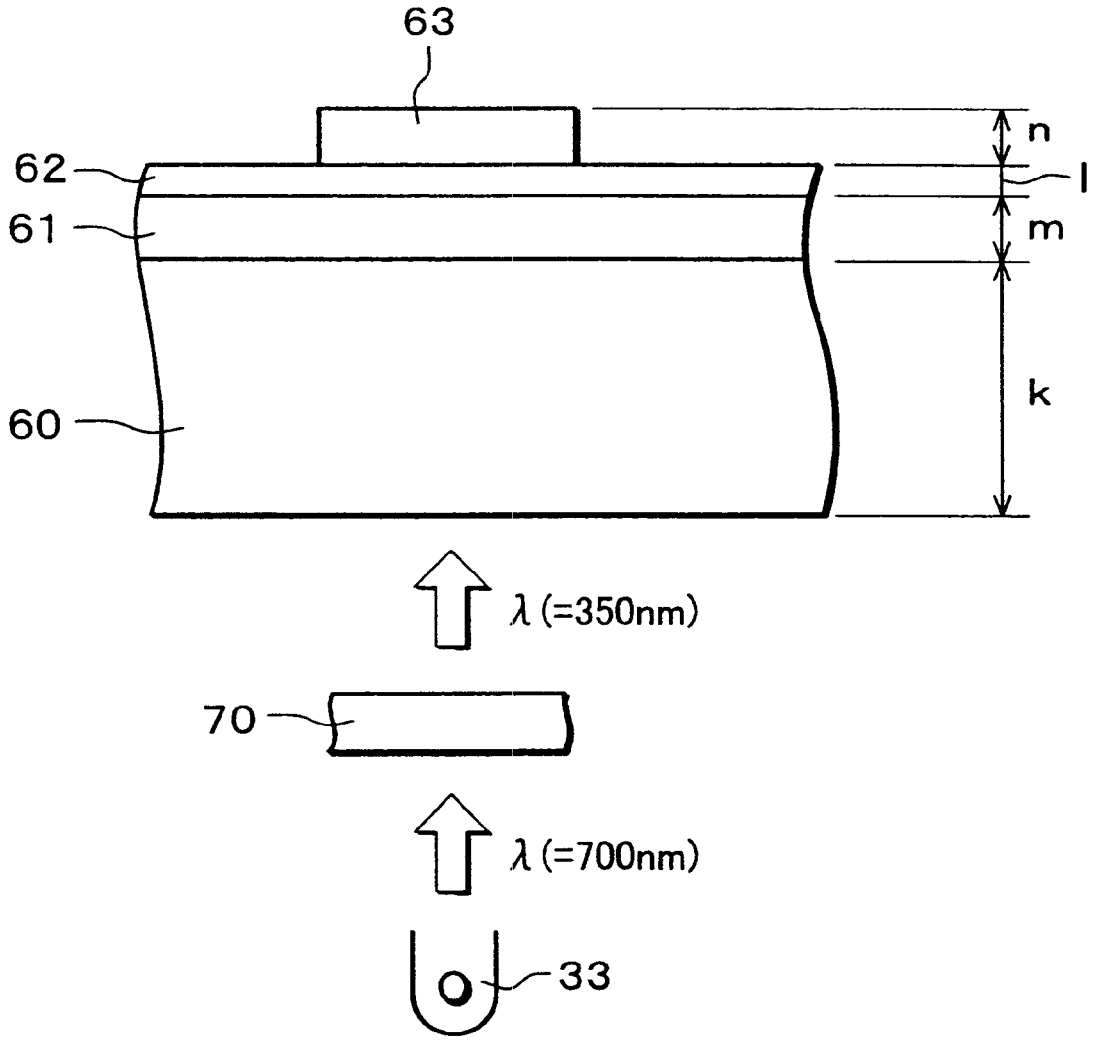
FIG. 9 is an explanatory drawing showing an example of a photoelectron charging test in a case where a wavelength converting element is provided.

Further, as shown in FIG. 9, a wavelength converting element (wavelength changing means) 70 may be provided between the toner charging roller 13 and the ultraviolet irradiater 33. In this case, a light ray whose wavelength is 700 nm is emitted from the ultraviolet irradiater 33.

The following description based on FIG. 9 is to describe an example of an experiment, performed by using a plate similar to the plate used in the experiment shown in FIG. 3 and providing the wavelength converting element 70, with respect to photoelectron charging in which electrons are induced from the toner charging roller 13 in accordance with irradiation of ultraviolet.

The wavelength converting element 70 is made of non-linear optical material. In this case, a light ray, emitted from the ultraviolet irradiater 33, which has a 700 nm wavelength is converted into ultraviolet having a 350 nm wavelength by the wavelength converting element 70 so as to be irradiated to the semiconductor 62. Thus, it is not required to prepare another ultraviolet irradiater for irradiating ultraviolet having a 350 nm wavelength which is most suitable for the semiconductor 62, so that it is possible to change the wavelength to ½ easily by using the original ultraviolet irradiater 33. In this manner, it is possible to adjust a wavelength easily according to material of which the metallic layer 32 is made, so that efficiency in charging can be improved. Further, it is possible to realize low cost in the ultraviolet irradiater 33.

As described above, the developing device according to Embodiment 1, which is used in an electrophotographic apparatus to develop an electrostatic latent image on a latent image support body by developer that has been charged, includes: transport means for supporting the developer so as to transport the developer to the latent image support body; and charging means which includes (a) an electron inducing section for inducing its electrons by receiving light irradiation and (b) irradiating means for irradiating light to the electron inducing section, and gives the electrons to the developer so as to charge the developer, wherein the charging means and the transport means have a space therebetween, and a grid electrode for controlling a flow of the electrons is provided in the space.

According to the foregoing arrangement, the charging means and the transport means have a space therebetween, so that developer and the charging means are not in contact with each other while having a great speed difference when the developer being transported is charged. Thus, mechanical/thermal load given to the developer and the charging means can be restricted. Thus, it is possible to prevent developer from deteriorating (from being damaged) and the device from deteriorating. Further, it is possible to prevent deterioration in charging property of developer. The deterioration in the charging property is brought about since developer softened by frictional heat between the charging means and the transport means adheres to the charging means or the transport means.

Further, the grid electrode is provided, so that it is possible to control a flow of electrons flowing from the charging means to the transport means. Thus, it is possible to restrict dispersion of the charging amount with respect to developer, so that it is possible to stabilize a surface potential of developer at a desired value. Thus, reliability of the developing device can be improved.

It is preferable that the developing device is arranged so that the developer is negatively charged, and an absolute value of the charging amount is not less than 5 $\mu$c/g and not more than 30 $\mu$c/g.

In the case where the charging amount of the developer is more than −5 $\mu$C/g, the developer can adhere to the transport means in a transport process of the developer, so that it is possible to prevent splash of the developer being transported. Further, the developer can adhere to a latent image support body upon developing an electrostatic latent image on the latent image support body, so that it is possible to prevent deterioration of printing density, for example, in the case where the developing device is provided in the printing apparatus.

While, in the case where the charging amount of the developer is less than −30 $\mu$C/g, the developer does not adhere to the latent image support body excessively upon developing the electrostatic latent image on the latent image support body. Thus, for example, in the case where the developing device is provided in the printing apparatus, it is possible to prevent rise in the printing density and occurrence of fog in printing. As described above, the charging amount of −5 $\mu$C/g to −30 $\mu$C/g is suitable to develop images by using developer. Thus, it is possible to improve reliability of the developing device.

It is preferable that the developing device is arranged so that a voltage, whose value is equal to a total value of (a) a value of a voltage for charging the developer and (b) a value of a voltage applied to the transport means, is applied to the grid electrode.

According to the foregoing arrangement, it is possible to charge the developer with a voltage whose value is equal to difference between a voltage applied to the grid electrode and a voltage applied to the transport means. Thus, it is possible to stabilize a surface potential of the toner layer at a desired value.

It is preferable that the developing device is arranged so that the electron inducing section is constituted of semiconductor or metal.

According to the foregoing arrangement, the charging means having the electron inducing section can easily emit electrons (has photoeffect). Therefore, since electrons induced by light irradiation can be directly given to the developer, it is possible to charge the developer easily. Thus, even when there is a space between the charging means and the transport means, it is possible to charge the developer.

It is preferable that the developing device is arranged so that a bias voltage is applied between the electron inducing section and the transport means.

According to the foregoing arrangement, electrons which have been induced from the electron inducing section are accelerated toward the transport means while bringing about electron avalanche. In this case, the accelerated electrons collide with gaseous molecules ($O_2$, $N_2$ etc.) in air, and the gaseous molecules are dissociated, so that new electrons can be generated sequentially.

It is preferable that the developing device is arranged so that (a) supplying means for supplying the developer to the transport means and (b) the charging means are provided in this order along a direction in which the developer is transported, and the supplying means and the charging means are opposite to the transport means, and the supplying means restricts a thickness of the developer transported on the transport means to a fixed thickness.

According to the foregoing arrangement, it is possible to restrict a thickness of the developer transported on the transport means to a fixed thickness. In this manner, a thickness of the developer is restricted to a fixed thickness, so that it is possible to charge the developer without fail. Thus, dispersion of the charging amount of the developer can be prevented, so that it is possible to improve charging performance of the developer. As a result, reliability of the developing device can be improved.

It is preferable that the developing device is arranged so that voltages having the same polarities are applied to the charging means, the grid electrode, and the transport means respectively, and the voltages satisfy a relationship of a voltage applied to the charging means>a voltage applied to the grid electrode>a voltage applied to the transport means.

According to the foregoing arrangement, an absolute value of a voltage applied to the charging means is larger than an absolute value of a voltage applied to the grid electrode. Thus, electrons which have jumped out of the charging means can be emitted from the grid electrode to the developer.

Further, an absolute value of a voltage applied to the grid electrode is larger than an absolute value of a voltage applied to the transport means. Thus, it is possible to charge the developer with a voltage whose value is equal to difference between a voltage applied to the grid electrode and a voltage applied to the transport means.

It is preferable that the developing device is arranged so that the developer is toner of 1 component system.

According to the foregoing arrangement, in the case where toner is used as the developer in the developing device, it is possible to effectively prevent such defects: the image quality is lowered and the device is damaged. These defects are brought about by fusing of the developer.

It is preferable that the developing device is arranged so that wavelength changing means for changing a wavelength of light irradiated from the irradiating means is provided between the electron inducing section and the irradiating means for irradiating the light to the electron inducing section.

According to the foregoing arrangement, it is possible to change a wavelength of light in the charging means, without preparing another irradiating means which irradiates light having the most suitable wavelength. Thus, it is possible to easily change a wavelength of light irradiated to the electron inducing section, without changing the irradiating means. Therefore, it is possible to easily adjust a wavelength according to material of which the electron inducing means is made, so that efficiency in charging can be improved. Further, it is possible to realize low cost in the irradiating means.

It is preferable that the developing device is arranged so that the irradiating means is provided opposite to the transport means with the electron inducing section therebetween.

According to the foregoing arrangement, light from the irradiating means can reach the electron inducing section without being irradiated to the developer etc. Thus, it is possible to prevent reduction in a light amount which is brought about by irradiating the light to the developer, and a light amount of the irradiating means can be secured. Further, it is possible to prevent the irradiating means from being soiled by the developer.

Further, a charging method of the present invention is to develop an electrostatic latent image into a visualized image, wherein light is irradiated to an electron inducing member which induces its electrons by receiving the light that has been irradiated, and the electrons that have been induced are emitted to the developer via a grid electrode so as to charge the developer.

According to the foregoing arrangement, light is irradiated to the electron inducing material which induces its electrons by receiving light irradiation, and the induced electrons are emitted to the developer so as to charge the developer, so that it is possible to restrict mechanical/thermal load given to the developer and the charging means for charging the developer. Thus, it is possible to prevent the developer from being damaged. Further, it is possible to prevent charging property of the developer from deteriorating.

Further, the electrons that have been induced are emitted to the developer via a grid electrode. Thus, it is possible to restrict dispersion of the charging amount with respect to developer, so that it is possible to stabilize a surface potential of developer at a desired value.

Further, the printing apparatus of the present invention includes: a latent image support body for supporting an electrostatic latent image formed in accordance with an image signal; and the above-mentioned developing device for developing the electrostatic latent image. The printing apparatus of the present invention includes the above-mentioned developing device, so that it is possible to provide a highly reliable printing apparatus.

[Embodiment 2]

Another embodiment of the present invention is described based on drawings as follows. First, a schematic arrangement of a developing device according to Embodiment 2 is described with reference to FIG. 10.

Figure 10:
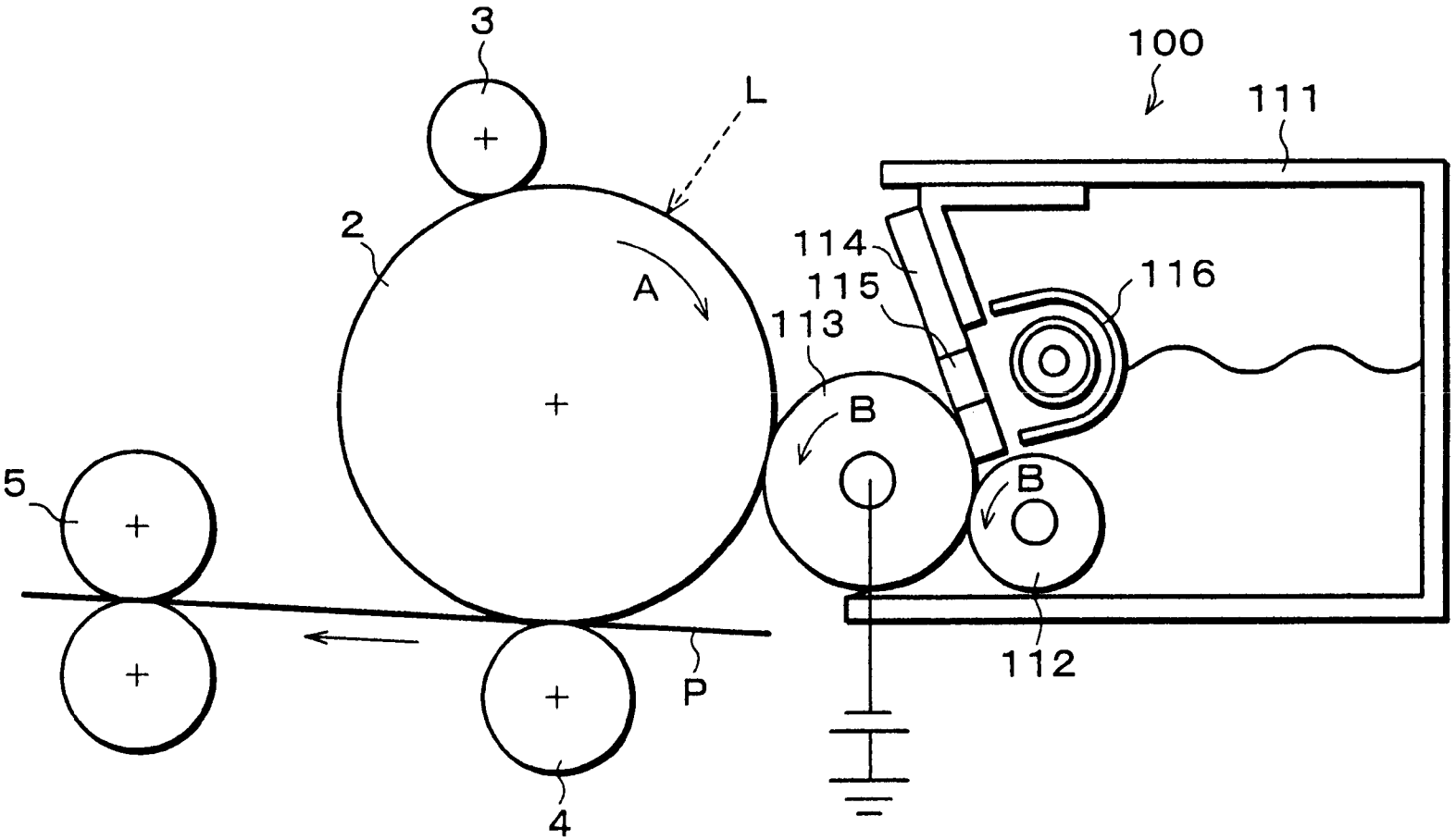
FIG. 10 is a cross sectional view showing a schematic arrangement of a developing device according to Embodiment 2 of the present invention.

A developing device 100, as shown in FIG. 10, is provided opposite to a photoreceptor drum 2, and develops an electrostatic latent image formed on a surface of the photoreceptor drum 2 by using, for example, toner (developer) made of nonmagnetic 1 component system as developer. The developing device 100 includes: a developer tank 111, a kind of a container for storing toner; a supplying roller (developer supplying means) 112; a developing roller (developer support body) 113; and a toner restricting blade (layer thickness restricting blade) 114.

The supplying roller 112 is provided in the developing device 100, and is in contact with the developing roller 113 rotatably so that outer surfaces of them face each other, and supplies toner stored in the developer tank 111 to the outer surface of the developing roller 113.

The developing roller 113 is provided in the developing device 100 rotatably so as to be opposite to the photoreceptor drum (latent image support body) 2, and supports toner supplied from the supplying roller 112 so as to transport the supplied toner to the photoreceptor drum 2.

The toner restricting blade 114 is provided on the downstream side with respect to the supplying roller 112 in a rotating direction of the developing roller 113 so as to be in contact with the developing roller 113 on the upstream side with respect to the photoreceptor drum 2, and restricts a layer thickness of a toner layer formed on the surface of the developing roller 113.

The developing device 100 further includes: an electron emitting section 115 provided on a portion of the toner restricting blade 114 as toner charging means (developer charging means) for charging toner supplied to the photoreceptor drum 2 to a predetermined charging amount; and an ultraviolet irradiater (light irradiating means) 116 for irradiating ultraviolet to the electron emitting section 115. The toner charging means will be detailed later.

Here, a schematic explanation is given as to a process section in an electrophotographic apparatus having the developing device 100.

The process section, as shown in FIG. 10, includes mainly: the photoreceptor drum 2; a charging roller 3; exposing means (not shown); the developing device 100; a transcription discharging roller 4; cleaning means (not shown); electricity removal means (not shown); and a fixing roller 5. Further, in FIG. 10, P refers to a recording paper, L refers to light beam which is irradiated from the exposing means so as to write an electrostatic latent image on a surface of the photoreceptor drum 2.

The photoreceptor drum 2 rotates in a predetermined direction (A-direction shown in FIG. 10), and its outer surface is uniformly charged by the charging roller 3. The light beam L which is controlled according to image data by the exposing means is irradiated on the uniformly charged surface of the photoreceptor drum 2, so that the electrostatic latent image is formed.

The electrostatic latent image formed on the photoreceptor drum 2 moves to a position opposite to the developing device 100 in accordance with rotation of the photoreceptor drum 2, and receives toner from the developing device 100 so as to visualize the image (toner image is formed on the photoreceptor drum 2). At this time, the developing roller 113 of the developing device 100 rotates in a predetermined direction (B-direction shown in FIG. 10) so as to carry and transport toner supplied to the photoreceptor drum 2.

Note that, in Embodiment 2, the photoreceptor drum 2 is constituted of organic photosemiconductor, and is charged to −700V (charging amount brought about by the charging roller 3), and rotates in A-direction at a circumpherential speed of 50 mm/s. The developing roller 113 is constituted of cylindrical conductive rubber elastic material, and a developing bias of −400V is applied to the developing roller 113, and the developing roller 113 rotates at the same speed as the photoreceptor drum 2 in B-direction. The supplying roller 112 is constituted of cylindrical foaming rubber elastic material, and rotates at the same speed as the photoreceptor drum 2 in B-direction.

The transcription discharging roller 4 transcribes the toner image, formed on the photoreceptor drum 2 in accordance with developing, on a recording paper P. On the downstream side with respect to the transcription discharging roller 4 in a rotating direction of the photoreceptor drum 2, the cleaning means and the electricity removal means are provided, and the cleaning means removes toner remaining on the surface of the photoreceptor drum 2 after the transcription, and the electricity removal means removes electricity on the surface of the photoreceptor drum 2.

The recording paper on which the toner image has been transcribed is transported to the fixing roller 5, and the recording paper P is heated and pressed while passing between a pair of fixing rollers 5, so that the toner image is fixed on the recording paper P.

Next, a detail process of developing performed in the developing device 100 is described.

In the developing device 100, as described above, toner is supplied sequentially from the supplying roller 112 to the surface of the developing roller 113, and the developing roller 113 rotates while carrying toner. Thus, toner transported by the developing roller 113 is guided to a portion between the developing roller 113 and a contact area Ws of the toner restricting blade 114, and a layer thickness of toner on the developing roller 113 is restricted. Note that, the contact area Ws is provided on an end of the toner restricting blade 114.

The toner, provided on the developing roller 113, whose layer thickness has been restricted by the toner restricting blade 114 is charged by the electron emitting section 115 and the ultraviolet irradiater 116 constituting the toner charging means, to such extent that developing can be performed. That is, the ultraviolet irradiater 116 irradiates ultraviolet to the electron emitting section 115 provided in the toner restricting blade 114, so that photoelectrons are induced from the electron emitting section 115 in accordance with photoeffect. The photoelectrons are emitted toward toner on the developing roller 113, so that the toner is charged to a desired charging amount. Note that, it is preferable that light emission of the ultraviolet irradiater 116 is performed in synchronism with rotation of the developing roller 113, because unnecessary light emission which results in increase in power consumption can be restricted. Further, although not shown in drawings, it is preferable that sealing is performed between the electron emitting section 115 and the ultraviolet irradiater 116 so as to prevent toner from entering a space therebetween and hindering the light irradiation.

In the toner charging means having the foregoing arrangement, the electron emitting section 115 is provided at a position different from the contact area Ws on the toner restricting blade 114, and the electron emitting section 115 is not in contact with toner on the developing roller 113, so that it is possible to charge the toner so that no load is given to the toner. Thus, in the developing device 100, the toner restricting blade 114 is pressed to the developing roller 113 at least to such extent that a layer thickness of toner can be restricted, so that it is possible to largely reduce pressure and thermal load given by the toner restricting blade 114 to toner.

Since a formation area of the electron emitting section 115 is completely separated from the developing roller 113, surface roughness of the electron emitting section 115 does not influence formation of the toner layer, so that there is no restriction in designing the surface roughness of the electron emitting section 115.

The toner which has been charged to a predetermined charging amount by the toner charging means is transported to a portion opposite to the photoreceptor drum 2 in accordance with rotation of the developing roller 113, and is electrostatically supplied to an electrostatic latent image on the surface of the photoreceptor drum 2, so that the electrostatic latent image is developed (visualized) into a toner image.

Next, a concrete arrangement of the toner restricting blade 114 is described with reference to FIG. 11(*a*) and FIG. 11(*b*).

Figure 11:
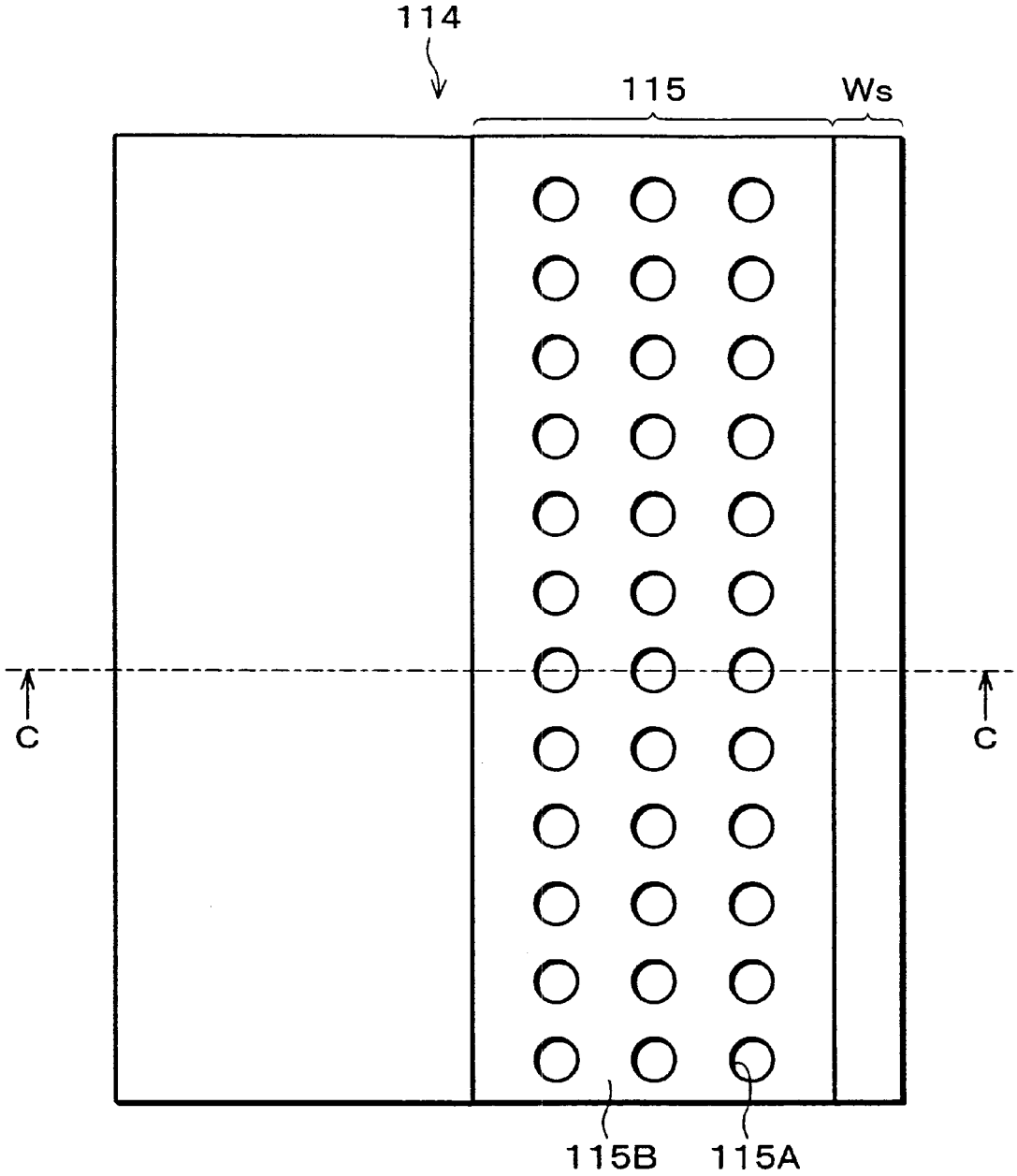
FIG. 11(*a*) and FIG. 11(*b*) show an arrangement of a toner restricting blade used in the developing device, and FIG. 11(*a*) is a plan view and FIG. 11(*b*) is a cross sectional view in C—C of FIG. 11(*a*).
Figure 11:
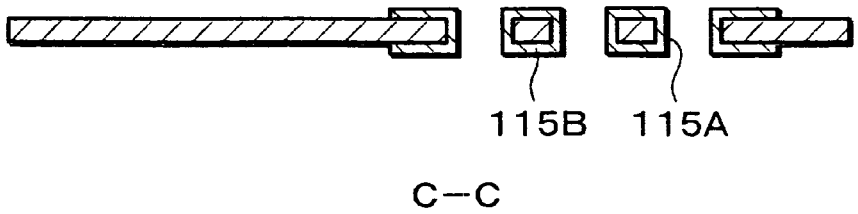

In forming the toner restricting blade 114, for example, as a backing material, an SUS metal (that is, a conductive backing material) is used, and as shown in FIG. 11(*a*) and FIG. 11(*b*), plural openings 115A are provided in accordance with etching etc. on an area where the electron emitting section 115 are formed. Further, a thin film of aluminium is laminated as photoelectric surface 115B on the area where the electron emitting section 115 is formed in accordance with, for example, deposition.

Although the openings 115A are made up of many small circular holes in FIG. 11(*a*), shape of the opening 115A is not limited to this, but the shape of the opening 115A may be a square or a triangle, and may be formed in a slit manner.

Further, material of which the photoelectric surface 115B is not limited to the above-mentioned aluminium, but may be metal such as Ta, alloy such as Mg—Ag, semiconductor, conductive polymer etc. as long as it brings about photoeffect upon receiving light irradiation. Further, it is not necessary that the photoelectric surface 115B is formed on both surfaces as shown in FIG. 11(*b*), and it is required to form the photoelectric surface 115B on at least a surface opposite to the ultraviolet irradiater 116.

Light irradiated to the electron emitting section 115 is not limited to the above-mentioned ultraviolet, but may be a visible ray or an X ray as long as the light has such a wavelength that can bring about photoeffect with respect to material of which the photoelectric surface 115B is made.

In the toner restricting blade 114 having the foregoing arrangement, when ultraviolet is irradiated to the photoelectric surface 115B of the electron emitting section 115, photoelectrons are induced on the photoelectric surface 115B in accordance with photoeffect. The photoelectrons are brought about mainly on the side to which ultraviolet is irradiated, that is, on a side opposite to the ultraviolet irradiater 116, and a part of the photoelectrons that have been brought about goes through opening 115A of the electron emitting section 115 and is irradiated from the side opposite to the developing roller 113 to the toner, and makes contribution in charging the toner.

It is easily understood that: when the electron emitting section 115 is electrically under a float condition, the photoelectric surface 115B of the electron emitting section 115 cannot continue to irradiate photoelectrons. Thus, it is required to arrange the electron emitting section 115 so that as many electrons as electrons emitted from the photoelectric surface 115B can be supplied from the outside. Here, the electron emitting section 115 is formed by depositing an aluminium thin film as the photoelectric surface 115B on a backing material of the toner restricting blade 114 which is constituted of SUS, so that it is possible to easily realize the foregoing arrangement by grounding the backing material of the toner restricting blade 114.

As described above, the developing device 100 according to Embodiment 2 can largely reduce pressure of the toner restricting blade 114 compared with a developing device using a conventional friction charging method. Thus, pressure and thermal load given to toner by the toner restricting blade are largely reduced, so that it is possible to avoid such defect that toner is damaged or toner is fused and adheres to the toner restricting blade 114.

As described above, the developing device according to Embodiment 2, which is used in an electrophotographic apparatus to develop an electrostatic latent image on a latent image support body by developer that has been charged, includes: a developer support body for supporting the developer so as to transport the developer to the latent image support body; and developer charging means for charging the developer, wherein the developer charging means is provided so as to be separated from the developer support body and is provided with an electron emitting section which can emit electrons toward the developer which is to be charged, and the developer charging means charges the developer by sprinkling the electrons, that have been emitted from the electron emitting section, over the developer.

According to the foregoing arrangement, the developing device is arranged so that the developer charging means can charge the developer. In this case, it is not necessary that a layer thickness restricting blade, which restricts a layer thickness of developer provided on the developer support body as a layer, has both functions: (a) a toner-layer-thickness restricting function and (b) a toner charging function as in a conventional developing device, but the layer thickness restricting blade can specialize in the toner-layer-thickness restricting function.

Further, the developer charging means is provided so as to be separated from the developer support body and charges the developer by sprinkling the electrons, that have been emitted from the electron emitting section, over the developer. That is, the developer charging means can charge the developer so that no load is given to the developer.

Thus, the developing device can largely reduce pressure given by the layer thickness restricting blade to the developer support body compared with a conventional layer thickness restricting blade. Thus, load (mechanical and thermal load) given to the developer is largely reduced, so that it is possible to avoid such defect that the developer is damaged or the developer is fused and adheres to the layer thickness restricting blade.

Further, it is preferable that the developing device is arranged so that the electron emitting section is provided on the layer thickness restricting blade for restricting a layer thickness of the developer provided as a layer on the developer support body so as not to be positioned on the contact area where the layer thickness restricting blade is in contact with the developer support body.

According to the foregoing arrangement, the electron emitting section is provided on a portion of the layer thickness restricting blade, so that it is not necessary that another new member is used to provide the electron emitting section. Thus, it is possible to reduce the number of members.

Further, it is preferable that the developing device is arranged so that the light irradiating means is provided opposite to one side of the layer thickness restricting blade, and the other side of the layer thickness restricting blade is opposite to the developer support body, and the layer thickness restricting blade includes an opening on an area which serves as the electron emitting section, and the area which serves as the electron emitting section has a photoelectric film, which emits the electrons upon receiving the light irradiated from the light irradiating means, at least on the one side opposite to the light irradiating means.

According to the foregoing arrangement, the electrons brought about in the photoelectric film due to the light irradiated from the light irradiating means pass through the opening and move toward the side of the developer support body, so that the developer which is provided on the developer support body as a layer is charged. Thus, the light irradiating means can be provided opposite to one side of the layer thickness restricting blade. The other side of the layer thickness restricting blade is opposite to the developer support body, and it is possible to secure a space where the light irradiating means is to be provided beside the one side of the layer thickness restricting blade. As a result, it becomes easier to design the developing device.

[Embodiment 3]

Still another embodiment of the present invention is described based on drawings as follows.

In the developing device according to Embodiment 2, the photoelectrons induced from the photoelectric surface 115B in accordance with the photoeffect go through the openings 115A of the electron emitting section 115 and are irradiated from the side opposite to the developing roller 113 to toner. However, in the foregoing arrangement, the photoelectrons brought about on the light irradiating side of the toner restricting blade 114 do not necessarily go through the openings 115A, so that photoelectrons which do not go through the openings 115A do not make any contribution with respect to charging of toner. Thus, according to the toner charging means of the above-mentioned developing device 100, charging efficiency with respect to toner is not so high.

Embodiment 3 gives a description as to a preferable example where it is possible to improve the charging efficiency with respect to toner in a developing device.

Figure 12:
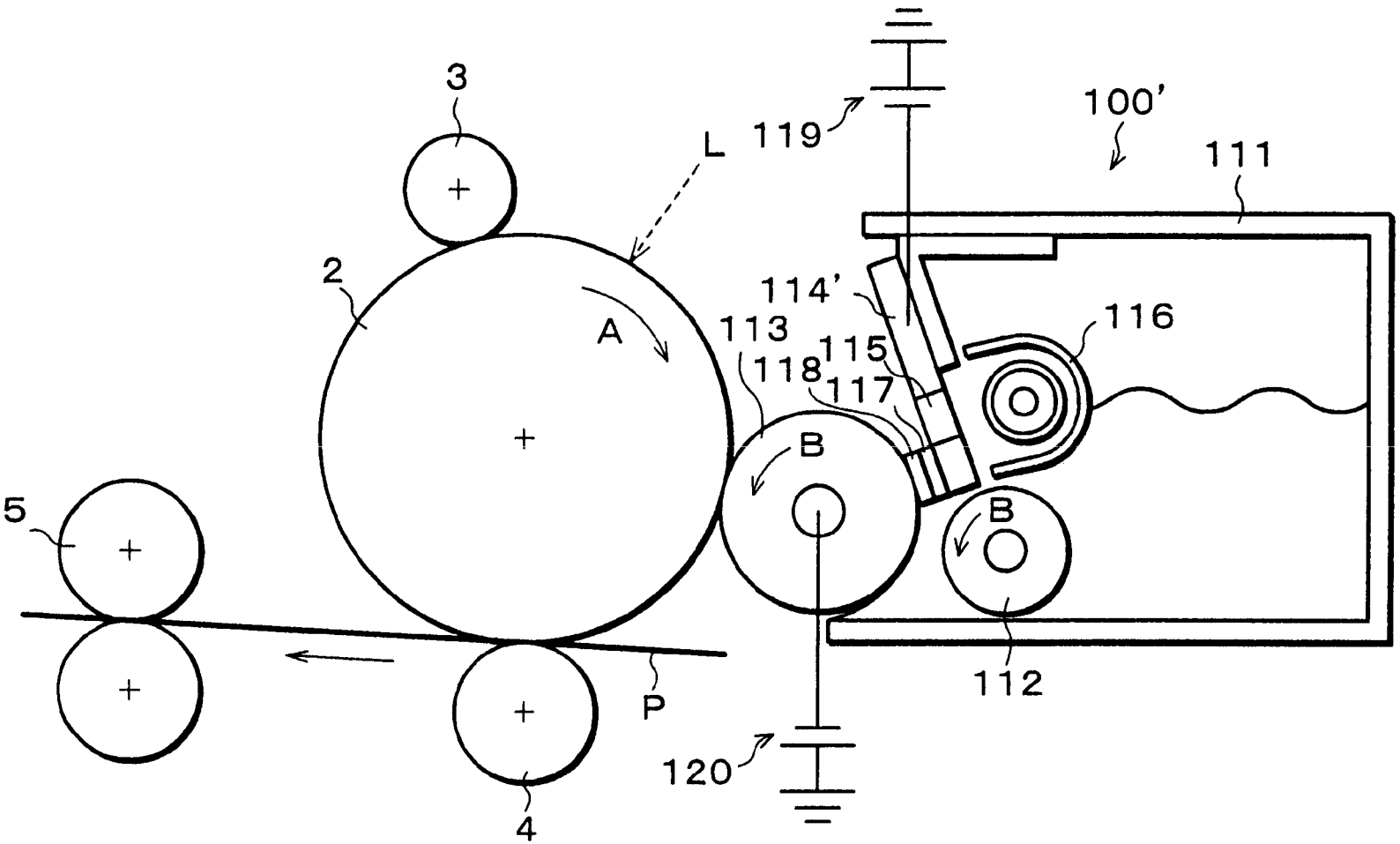
FIG. 12 is a cross sectional view showing a schematic arrangement of a developing device according to Embodiment 3 of the present invention.

In a developing device 100' according to Embodiment 3, as shown in FIG. 12, is different from the developing device 100 in that a toner restricting blade 114' is used instead of the toner restricting blade 114, and an electric bias is applied between the toner restricting blade 114' and the developing roller 113. Thus, the toner restricting blade 114' is connected to a bias applying means 119. The bias applying means 119 can be connected to a backing material of the toner restricting blade 114'. Further, it is possible to use the bias applying means, which applies a developing bias between the photoreceptor drum 2 and the developing roller 113, as a bias applying means 120 on the side of the developing roller 113. Except for the foregoing arrangement, the developing device 100' has the same arrangement as the developing device 100.

Figure 13:
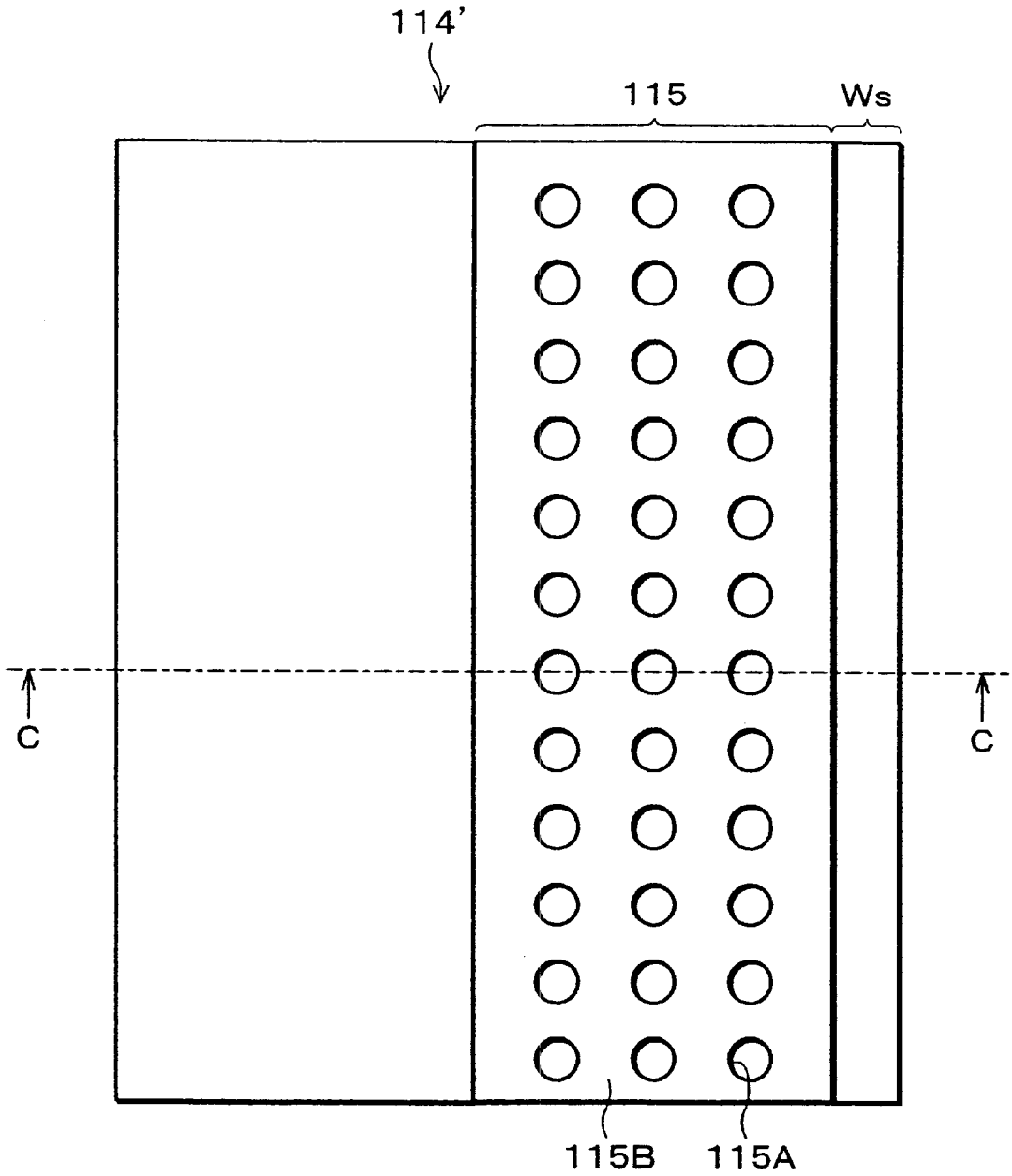
FIG. 13(*a*) and FIG. 13(*b*) show an arrangement of a toner restricting blade used in the developing device, and FIG. 13(*a*) is a plan view and FIG. 13(*b*) is a cross sectional view in C—C of FIG. 13(*a*).
Figure 13:
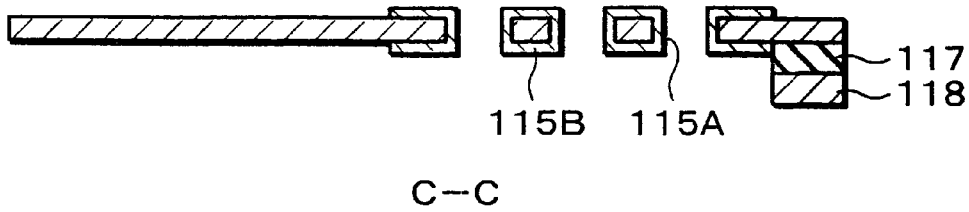

With reference to FIG. 13(*a*) and FIG. 13(*b*), a concrete arrangement of the toner restricting blade 114' is described.

Although the arrangement of the toner restricting blade 114' is substantially similar to that of the toner restricting blade 114, as shown in FIG. 13(*b*), the toner restricting blade 114' is different from the toner restricting blade 114 in that an insulating layer 117 and a metallic layer 118 are provided on the contact area Ws which is in contact with the developing roller 113. Note that, the electron emitting section 115 formed on the toner restricting blade 114' is arranged as in the toner restricting blade 114.

In the developing device 100', an electric bias is applied between the toner restricting blade 114' and the developing roller 113. Thus, when a conductive backing material of the toner restricting blade 114 is directly in contact with the developing roller 113 like the developing device 100, conduction is made between the toner restricting blade 114 and the developing roller 113, so that the above-mentioned electric bias cannot be applied.

That is, the insulating layer 117 is provided so as to perform insulation between the developing roller 113 and the toner restricting blade 114', and, for example, is formed on the foregoing backing material as a fluororesin layer having a 80 $\mu$m thickness.

Further, the metallic layer 118 has suitable hardness and surface roughness on its contact surface which is in contact with the developing roller 113 so that uniformed toner layer can be formed on a surface of the developing roller 113. As the metallic layer 118, for example, a metallic layer of SUS having a 20 $\mu$m thickness is laminated.

Note that, an arrangement in which insulation is performed between the developing roller and the toner restricting blade is not limited to the foregoing arrangement in which the insulating layer is provided on the side of the toner restricting blade, but may be an arrangement in which an insulating layer such as rubber is provided on an outer layer of the developing roller constituted of conductive backing material.

In the developing device 100' of the foregoing arrangement, by applying an electric bias between the toner restricting blade 114' and the developing roller 113, it is possible to improve the charging effect in accordance with the following two actions.

Figure 14:
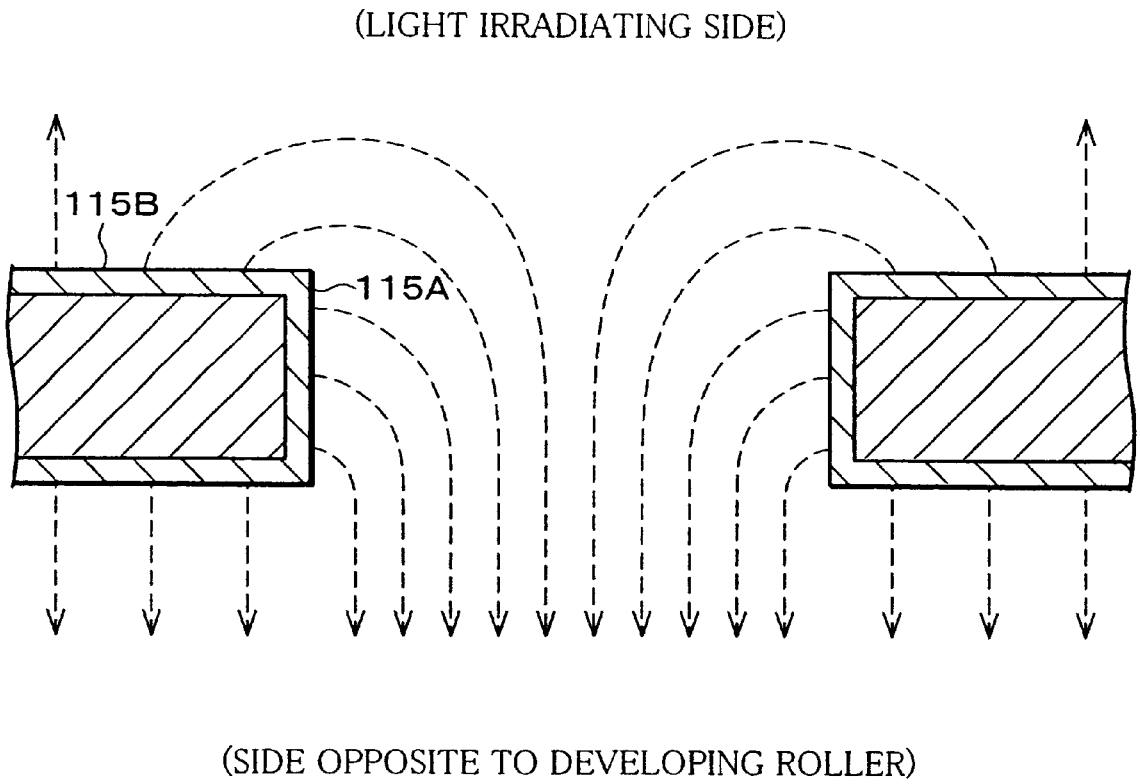
FIG. 14 is a drawing which describes lines of electric force which occurs in the vicinity of an opening of the toner restricting blade in a case where an electric bias is applied between the toner restricting blade and the developing roller.

First, as the first action, by applying the electric bias, there occurs an electric field between the toner restricting blade 114' and the developing roller 113. At this time, there occurs a line of electric force (shown by the broken line in FIG. 14) as shown in FIG. 14 in the vicinity of the openings 115A of the electron emitting section 115 provided on the toner restricting blade 114'.

Thus, in the photoelectric surface 115B of the electron emitting section 115, photoelectrons which have occurred in the vicinity of the openings 115A move along the line of electric force, and are attracted to the side of the developing roller 113 through the openings 115A. That is, the photoelectrons which have occurred can be efficiently used to charge toner.

Next, as the second action, the photoelectrons attracted to the side of the developing roller 113 are accelerated in accordance with the action of the electric field. When the accelerated photoelectrons collide with gaseous molecules, the gaseous molecules emit electrons so as to be made ion. At this time, the electrons emitted from the gaseous molecules act as in the accelerated electrons, so that electrons in air are greatly increased, that is, electron avalanche occurs. Since electrons brought about by the electron avalanche also contribute to charging of toner, the charging efficiency is largely improved.

Here, an electric bias between the developing roller 113 and the toner restricting blade 114' is applied so that the electric filed strength is in a range of 0.5 to $2.5\times10^6$ (V/m).

Figure 15:
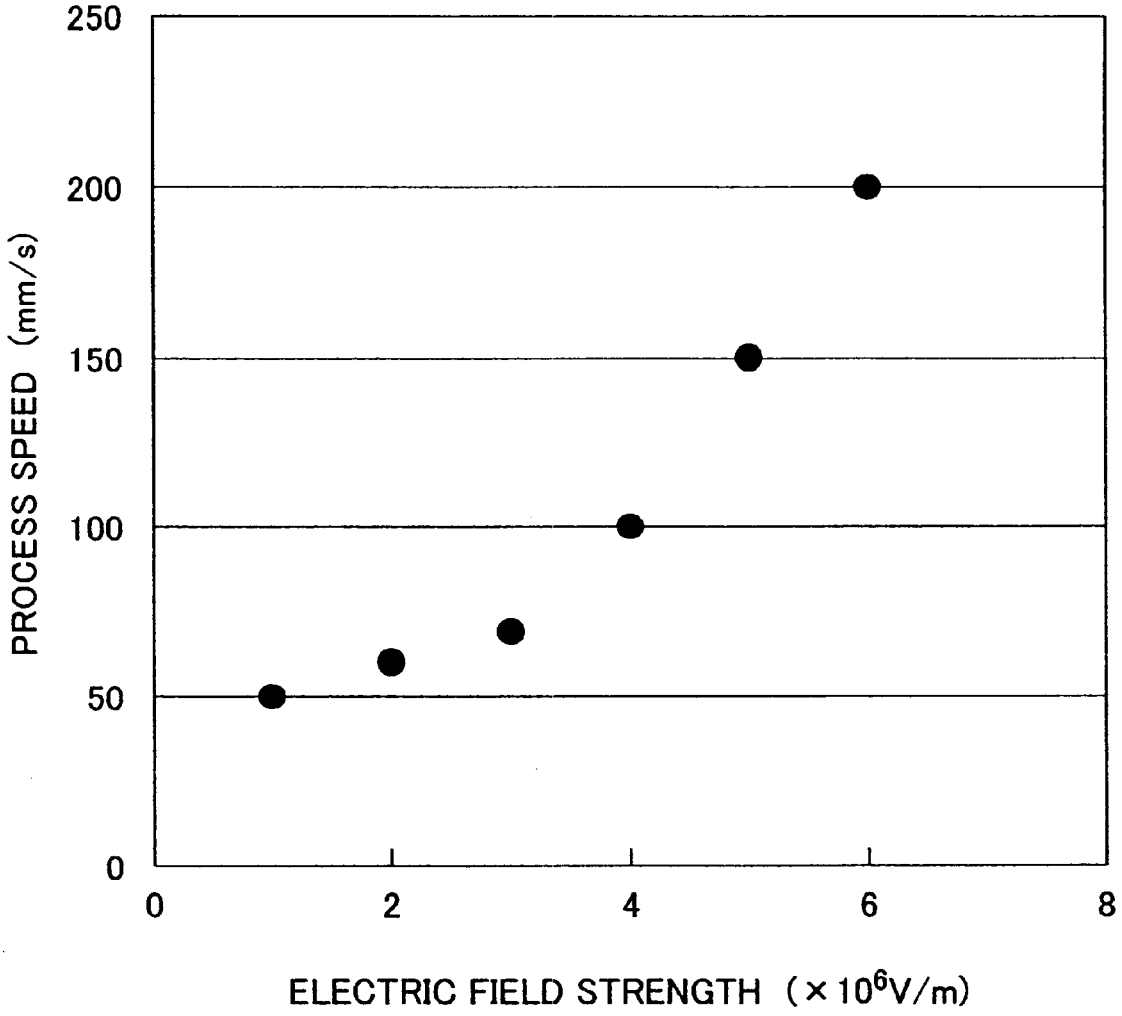
FIG. 15 is a graph showing how electric field strength of the electric bias applied between the toner restricting blade and the developing roller relates to a process speed at which images can be formed.

FIG. 15 shows a relationship between the electric field strength and a process speed in the case where the desired charging amount ($-2.0\times10^{-2}$ $\mu$C/kg) can be obtained. It is obvious from FIG. 15 that by raising the electric field strength of the electric bias, the process speed at which the desired charging amount can be obtained is improved, and in a case where an electric bias in the foregoing range is applied, toner can be charged to such extent that the process speed is 50 to 200 mm/s.

Figure 16:
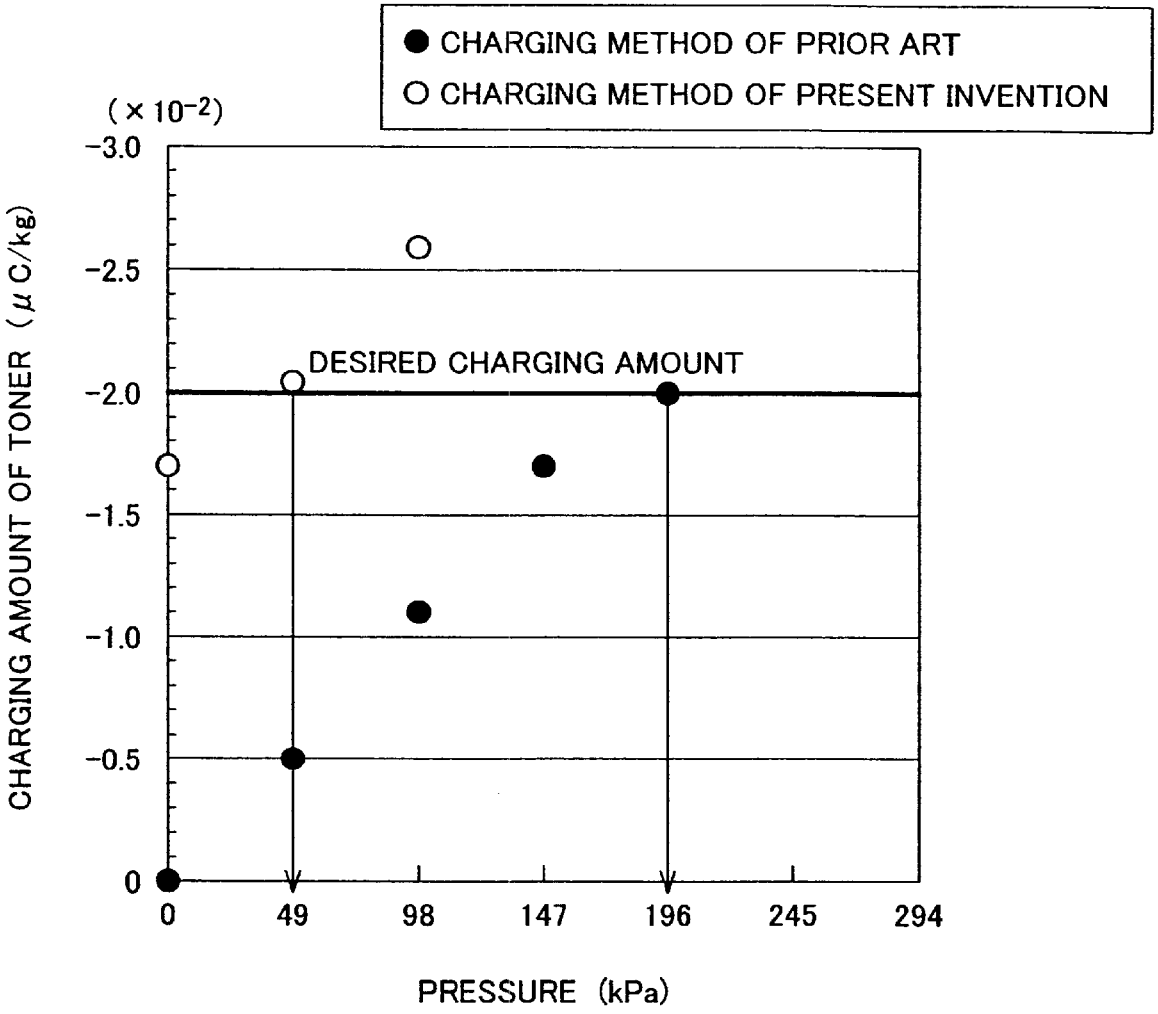
FIG. 16 is a graph showing how a toner charging amount in the developing device relates to pressure of the toner restricting blade.

FIG. 16 shows a relationship between pressure of the toner restricting blade and a charging characteristic of toner in the arrangement of the developing device according to Embodiment 3. A patterning condition of the openings 115A of the electron emitting section 115 is that aperture ratio is 40% and a hole diameter of the opening 115A is $\phi$200 $\mu$m. The ultraviolet irradiater 116 irradiates ultraviolet having a 254 nm wavelength. Note that, the aperture ratio is ratio of area occupied by the openings 115A with respect to an area where the electron emitting section 115 is formed. Further, an electric bias of $5\times10^{-6}$V/m is applied between the developing roller 113 and the toner restricting blade 114'.

FIG. 16 shows that pressure of about 196 kPa is required to obtain the desired charging amount in a friction charging method of the prior art. On the other hand, according to the friction charging method of the present invention, the desired charging amount can be obtained by a quarter of pressure required in the friction charging method of the prior art, that is, by pressure of about 49 kPa.

As described above, the developing device according to Embodiment 3 is arranged so that the layer thickness restricting blade is insulated against the developer support body, and the developer charging means includes bias applying means for applying an electric bias between the layer thickness restricting blade and the developer support body.

According to the foregoing arrangement, photoelectrons which have been emitted from the photoelectric film are attracted to the side of the developer support body. Further, the attracted electrons are accelerated by the bias so as to bring about electric avalanche, so that this can amplitude electrons which make contribution in charging the developer. Thus, it is possible to charge the developer with great efficiency.

[Embodiment 4]

Still another embodiment of the present invention is described based on drawings as follows.

According to Embodiments 2 and 3, in the electron emitting section 115 of the toner restricting blade 114 or the toner restricting blade 114', a shape of the opening 115A at a cross section of the blade (see FIG. 11(*b*)) is a rectangular. That is, as to the opening 115A of the electron emitting section 115 of Embodiments 2 and 3, an opening area on a light irradiating side is equal to an opening area on a side opposite to the developing roller 113.

On the other side, as to a toner restricting blade according to Embodiment 4, a shape of an opening in the electron emitting section is arranged so that an opening area on the light irradiating side is made larger than an opening area on the side opposite to the developing roller 113, so that a light receiving area of the electron emitting section 115 is increased, thus it is possible to increase the number of the occurring electrons.

Figure 17:
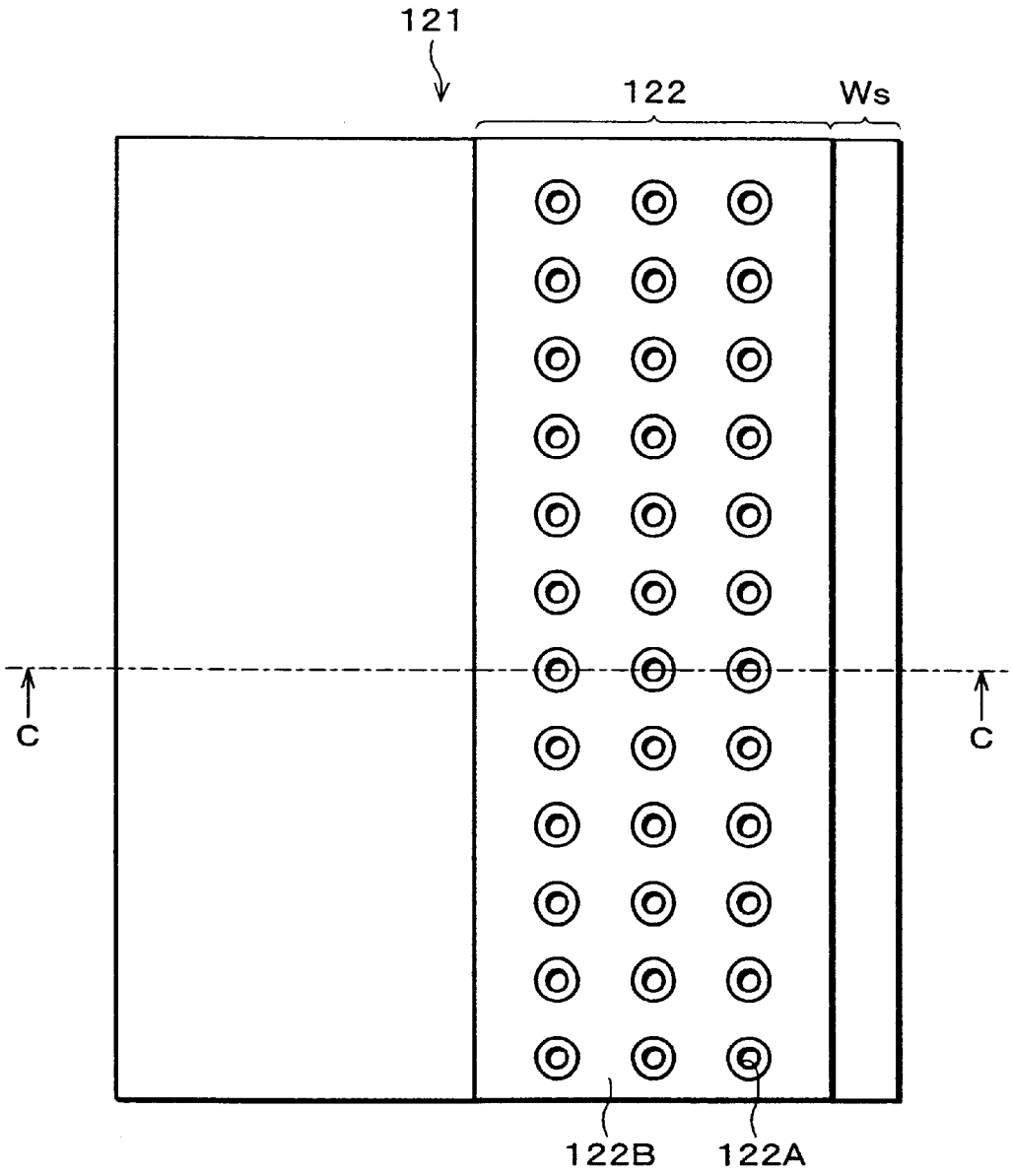
FIG. 17(*a*) and FIG. 17(*b*) show an arrangement of a toner restricting blade used in a developing device according to Embodiment 4 of the present invention, and FIG. 17(*a*) is a plan view and FIG. 17(*b*) is a cross sectional view in C—C of FIG. 17(*a*).
Figure 17:
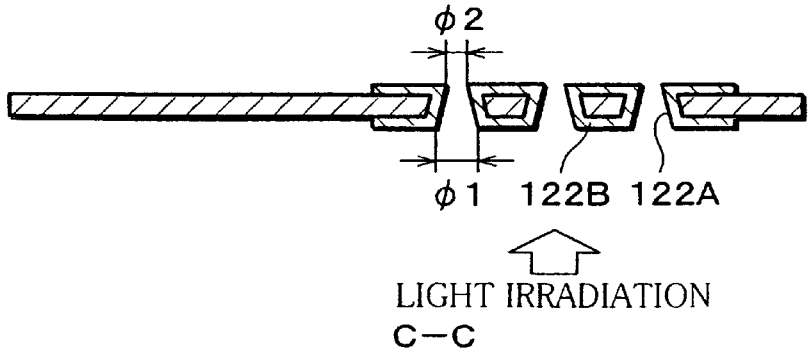

FIG. 17(*a*) and FIG. 17(*b*) show an example of the toner restricting blade in Embodiment 4.

In a toner restricting blade 121 shown in FIG. 17(*a*) and FIG. 17(*b*), for example, as a backing material, a metal of SUS (that is, conductive backing material) is used, and an electron emitting section 122 is formed on a part of the metal. In the electron emitting section 122, plural openings 122A are provided, and a thin film of aluminium is laminated as a photoelectric surface 122B in accordance with, for example, deposition.

Here, the opening 122A has a bowl-shape so that a relationship between an opening diameter $\phi 1$ on the light irradiating side and an opening diameter $\phi 2$ on the side opposite to the developing roller 113 is $\phi 1 > \phi 2$. Note that, it is possible to form the openings 122A having the foregoing shape in the toner restricting blade 121 easily in accordance with, for example, one-side etching (note that, it is possible to form straight holes as shown in FIG. 11(*a*) and FIG. 11(*b*) in accordance with both-sides etching). Further, the photoelectric surface 122B are formed at least on the light irradiating side and on the inside of the openings 122A in the electron emitting section 122.

In the case where the electron emitting section 122 has the bowl-shape, light irradiated to the electron emitting section 122 is received by the photoelectric surface 122B and the inside of the openings 122A. Thus, the light receiving area of the electron emitting section 122B can be increased, so that it is possible to increase the number of the occurring electrons so as to stabilize the charging of toner.

However, as long as the openings 122A satisfy the condition: (opening area of the light irradiating side)>(opening area on the side opposite to the developing roller 113), its shape is not particularly limited as in the case of the electron emitting section 115 of Embodiments 2 and 3.

The toner restricting blade 121 may be arranged so that, like the developing device 100 according to Embodiment 2, the electric bias is not applied between the toner restricting blade 121 and the developing roller 113. However, it is preferable to arrange the toner restricting blade 121 so that an insulating layer is provided on the contact area Ws which is in contact with the developing roller 113 and an electric bias is applied between the toner restricting blade 121 and the developing roller 113 as in the developing device 100' according to Embodiment 3.

As described above, in the developing device according to Embodiment 4, the opening has a slope so that (opening area on a light irradiating side)>(opening area on a side where the electrons are emitted) and the electron emitting section has the photoelectric film at least on the one side opposite to the light irradiating means and on an inner portion of the opening.

According to the foregoing arrangement, in the area which serves as the electron emitting section, a photoelectric film, which is formed on the inner portion of the opening as well as the photoelectric film formed on the one side opposite to the light irradiating means, receives the light irradiated from the light irradiating means so as to emit photoelectrons. Thus, the utility efficiency of the irradiated light can be improved.

[Embodiment 5]

Still another embodiment of the present invention is described based on drawings as follows.

Figure 18:
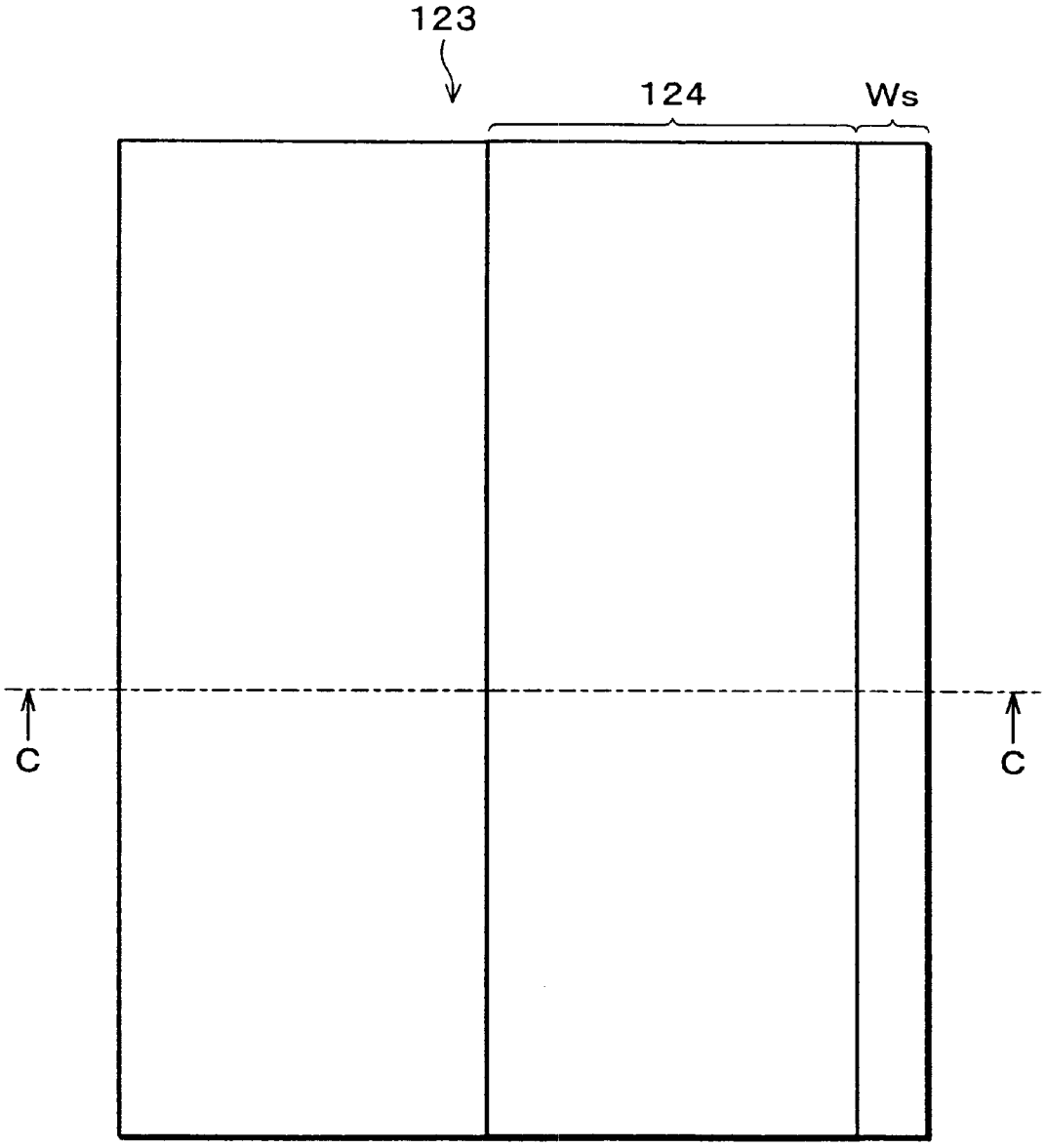
FIG. 18(*a*) and FIG. 18(*b*) show an arrangement of a toner restricting blade used in a developing device according to Embodiment 5 of the present invention, and FIG. 18(*a*) is a plan view and FIG. 18(*b*) is a cross sectional view in C—C of FIG. 18(*a*).
Figure 18:
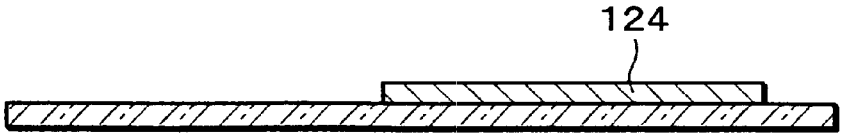

A developing device according to Embodiment 5 is arranged so that a toner restricting blade 123 as shown in FIG. 18(*a*) and FIG. 18(*b*) is used instead of the toner restricting blades 114, 114', and 121 described in Embodiments 2 to 4.

The toner restricting blade 123 is arranged so that, as shown in FIG. 18(*a*) and FIG. 18(*b*), a transparent backing material such as glass, fused quartz, and acrylate resin is used, and a metallic thin film is formed as an electron emitting section 124 on the transparent backing material's surface opposite to the developing roller 113. Of course, material of which the electron emitting section 124 is made is not limited as long as photoeffect is brought about upon receiving light irradiation, so that the material may be, for example, metal such as Al or Ta, alloy such as Mg—Ag, semiconductor, and conductive polymer.

In the toner restricting blade 123, light irradiated to the toner restricting blade 123 is irradiated from the transparent baking material, and passes through the transparent baking material so as to arrive at the electron emitting section 124.

Here, unlike the electron emitting sections 115 and 122 of the toner restricting blades 114 and 121, the electron emitting section 124 does not include the openings 115A and 122A. That is, the electron emitting section 124 is constituted of only the metallic thin film which acts as a photoelectric surface.

In this case, in order to emit photoelectrons, which have occurred in accordance with photoeffect brought about by light irradiated from the transparent backing material, to the side opposite to the developing roller 113, a path through which the photoelectrons pass is required in the metallic thin film constituting the electron emitting section 124. Here, in the electron emitting section 124, metallic material is not necessarily made into a uniformed film having no cavity, but the electron emitting section 124 has many cavities therein. Thus, in the electron emitting section 124, it is possible to emit the photoelectrons which have occurred through the cavities to the side opposite to the developing roller 113.

However, as to the electron emitting section 124, even when the foregoing cavities occur in the metallic thin film, in a case where a film thickness of the metallic thin film is too large, the cavities less form the path through which photoelectrons pass to the side opposite to the developing roller 113. Thus, in the arrangement of the toner restricting blade 123 according to Embodiment 5, it is required to appropriately set the film thickness of the metallic thin film constituting the electron emitting section 124.

Figure 19:
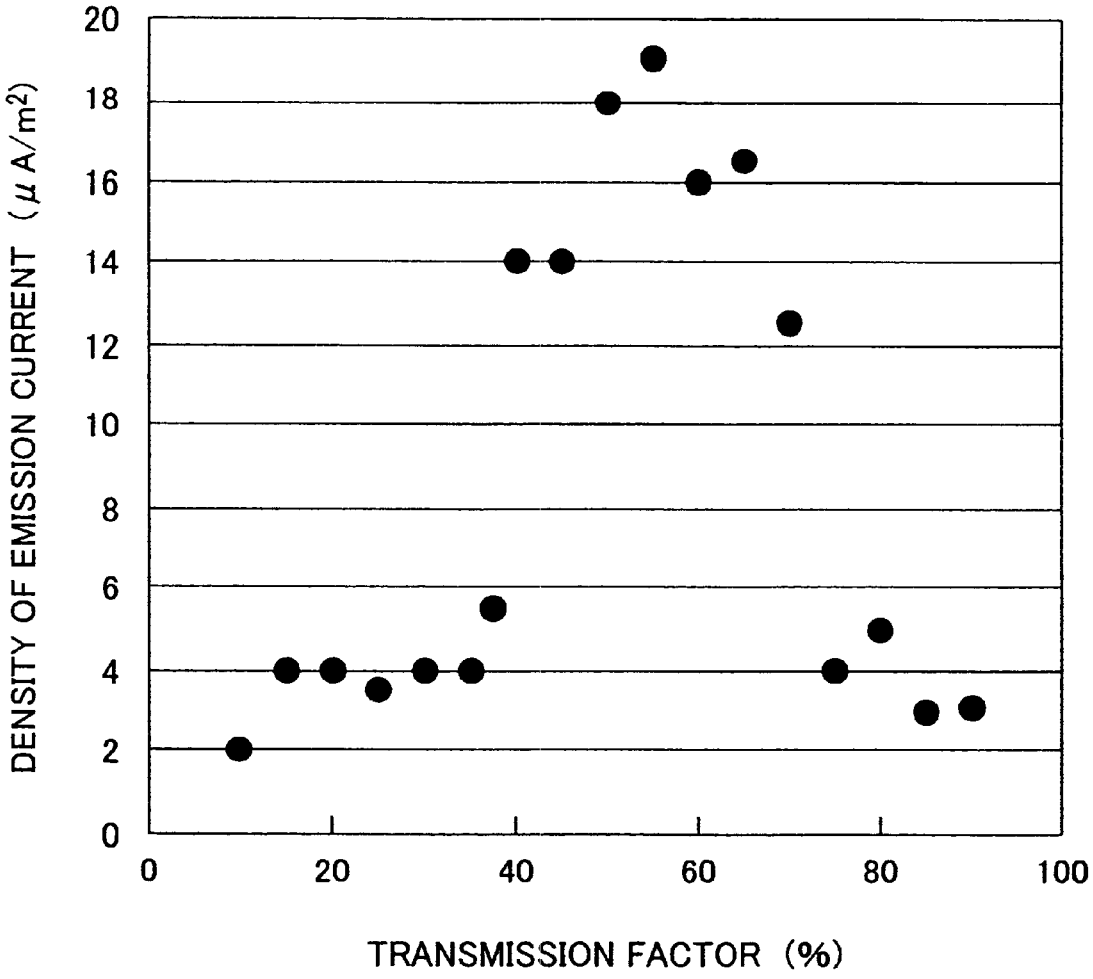
FIG. 19 is a graph showing how transmission factor of an electron emitting section formed on the toner restricting blade relates to density of an emission current of electrons emitted from the electron emitting section.

Here, FIG. 19 shows a relationship between the film thickness of the metallic thin film and density of an emission current in the electron emitting section 124. However, the film thickness of the metallic thin film closely relates to light transmittance of the metallic thin film (transmittance rises as the film thickness is reduced), and an axis of abscissas shown in FIG. 19 refers to the transmittance as a parameter which indicates the film thickness. Further, FIG. 19 shows the case where an electric bias is applied between the toner restricting blade 123 and the developing roller 113.

This shows that, in the electron emitting section 124, the density of the emission current is largely increased so that the transmittance of the metallic thin film is within 40 to 70%. The cause of this is that: when the transmittance is more than 70%, the film thickness of the electron emitting section 124 is too large, so that the photoelectrons which have been brought about are hard to be emitted to the side opposite to the developing roller 113. Further, when the transmittance is less than 40%, the continuity in an inside direction of the metallic thin film is lost in the electron emitting section 124, and an electric bias is not applied to a whole area of the electron emitting section 124, so that electron avalanche does not act sufficiently.

That is, in the developing device, it is preferable that a photoelectric film of the electron emitting section 124 is formed so that its light transmittance is not less than 40% and not more than 70%. According to the foregoing arrangement, the light transmittance of the photoelectric film is adjusted most suitably, so that it is possible to obtain high charging efficiency.

Note that, like the developing device according to Embodiment 2, the toner restricting blade 123 according to Embodiment 5 may be arranged so that an electric bias is not applied between the toner restricting blade 123 and the developing roller 113. However, like the developing device 100' according to Embodiment 3, it is preferable to make an arrangement in which an insulating layer is provided on the contact area Ws which is in contact with the developing roller 113 so as to an electric bias is applied between the toner restricting blade 123 and the developing roller 113.

In the case where an electric bias is applied between the toner restricting blade 123 and the developing roller 113, since a backing material of the toner restricting blade 123 is not conductive, bias applying means 119 (see FIG. 12) for applying the electric bias is connected to the electron emitting section 124. Further, even when it is arranged so that an electric bias is not applied between the toner restricting blade 123 and the developing roller 113, the electron emitting section 124 is directly connected to a grounding terminal.

Alternately, it may be arranged as follows. A transparent conductive layer made of, for example, ITO (Indium Tin Oxide) on a lower layer of the electron emitting section 124, so that a bias is applied to the electron emitting section 124 via the transparent conductive layer, and the electron emitting section 124 is grounded.

Note that, also in the metallic thin film 32 of Embodiment 1, the charging efficiency is improved by suitably setting the transmittance of the metallic thin film which serves as the electron emitting section.

As described above, in the developing device according to Embodiment 5, the light irradiating means is provided opposite to one side of the layer thickness restricting blade, and the other side of the layer thickness restricting blade is in contact with the developer support body, and the layer thickness restricting blade includes a photoelectric film, which emits electrons upon receiving the light irradiated from the light irradiating means, on an area which serves as the electron emitting section made of a backing material having light transmittance, and the area is the other side opposite to the developer support body.

According to the foregoing arrangement, the light irradiated from the light irradiating means passes through a baking material having light transmittance and reaches the photoelectric film, and photoelectrons brought about by photoeffect are emitted toward the side of the developer support body, so that the developer provided on the developer support body as a layer is charged. Thus, the light irradiating means can be provided opposite to one side of the layer thickness restricting blade. The other side of the layer thickness restricting blade is opposite to the developer support body, and it is possible to secure a space where the light irradiating means is to be provided beside the one side of the layer thickness restricting blade. As a result, it becomes easier to design the developing device.

[Embodiment 6]

Still another embodiment of the present invention is described based on drawings as follows.

The developing device according to Embodiments 2 to 5 is arranged so that the electron emitting section of the toner charging means is provided on a part of the toner restricting blade. According to the arrangement, it is not required to newly provide a member for forming a photoelectric film on the electron emitting section, so that it is possible to realize miniaturization of the developing device and low cost.

While, in the developing device, toner which is charged by the toner charging means is toner whose layer thickness has been restricted on the developing roller 113. Thus, in a toner layer formed on the developing roller 113, toner on an outer side receives many electrons emitted from the toner charging means, so that the charging amount is increased, but the charging amount of toner on an inner side is reduced. That is, uniformity of the ultimate toner charging is lowered.

On the other hand, a developing device according to Embodiment 6 has an arrangement which is suitable to heighten the uniformity of the toner charging by making a difference in a position of the toner charging means from the developing device according to Embodiments 2 to 5.

Figure 20:
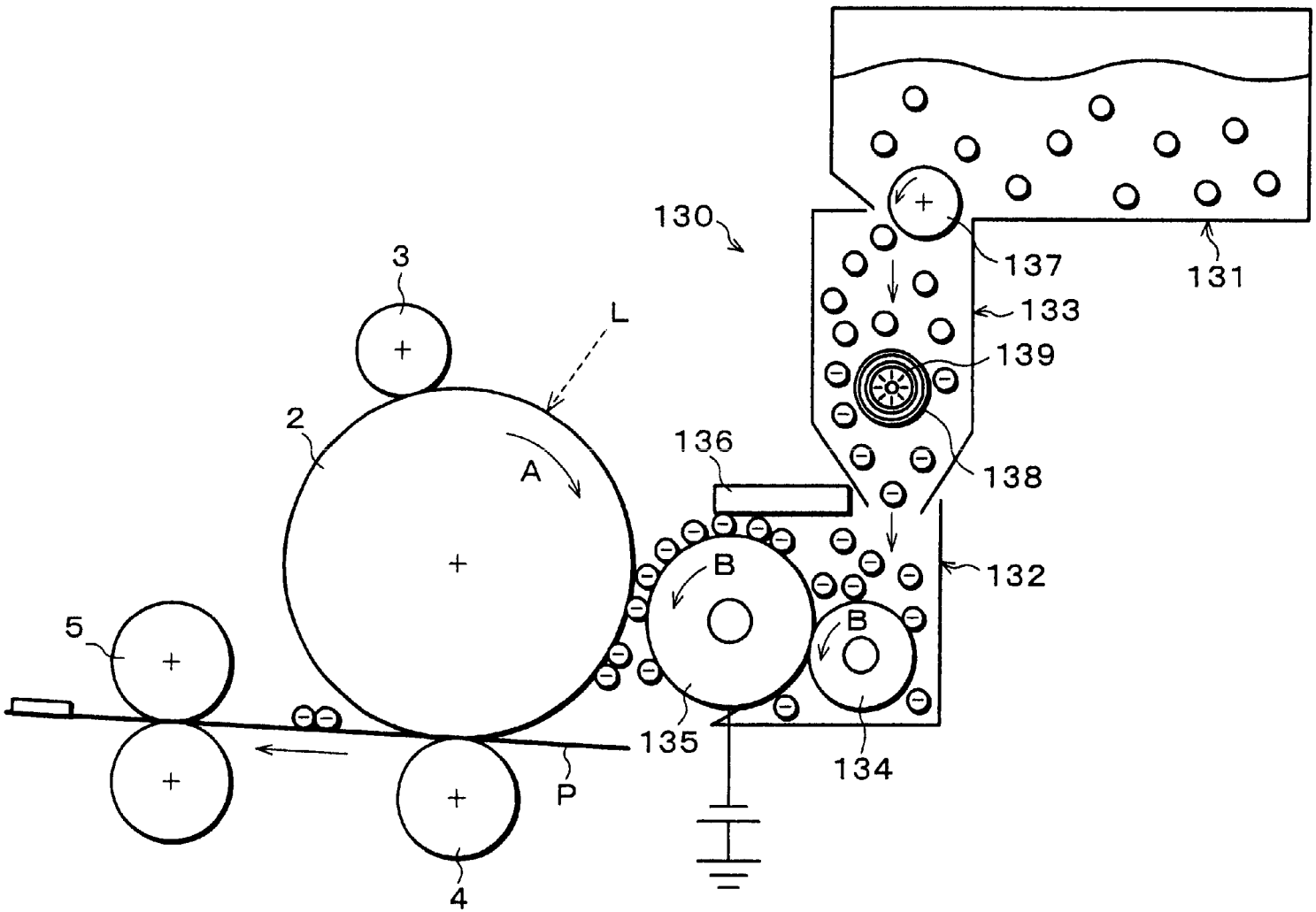
FIG. 20 is a cross sectional view showing a schematic arrangement of a developing device according to Embodiment 6 of the present invention.

The developing device according to Embodiment 6, as shown in FIG. 20, is provided opposite to the photoreceptor drum 2, and an electrostatic latent image formed on a surface of the photoreceptor drum 2 is developed by using toner made of, for example, nonmagnetic of 1 component system as developer. The developing device 130 includes a hopper 131, a developer tank 132, and a charging tank 133.

The hopper 131 is a tank positioned most upstream in the developing device 130, and stores uncharged toner.

The developer tank 132 is a tank which stores toner supplied to the photoreceptor drum 2, and includes a supplying roller 134, a developing roller 135, and a toner restricting blade 136.

The supplying roller 134 and the developing roller 135 are provided rotatably and adjacently so that outer surfaces of them are in contact with each other. Further, the supplying roller 134 supplies toner in the developer tank 132 to the outer surface of the developing roller 135, and the developing roller 135 carries and transports the toner supplied from the supplying roller 134 toward the photoreceptor drum 2. The toner restricting blade 136 is provided on the downstream side of the supplying roller 134 with respect to a rotating direction of the developing roller 135 SO as to be in contact with the developing roller 135 on the upstream side of the photoreceptor drum 2, and restricts a layer thickness of a toner layer formed on the surface of the developing roller 135.

The charging tank 133 is provided on the downstream side of the hopper 131, on the upstream side of the developer tank 132, and is to charge toner replenished from the hopper 131 toward the developer tank 132. That is, in a case where it is detected that toner runs out, the hopper 131 rotates the toner replenishing roller 137 so as to replenish toner toward the developer tank 132. At this time, toner replenished from the hopper 131 to the developing tank 132 passes through the charging tank 133 without fail, and is charged by the charging tank 133.

Thus, the charging tank 133 has toner charging means constituted of (a) a toner charging roller (charging member) 138 for receiving light irradiation so as to induce its electrons, and (b) a cold cathode glass lamp 139 for irradiating ultraviolet to the toner charging roller 138. A process section of the toner charging means will be detailed later.

Here, a schematic description is given as to a process section of an electrophotographic apparatus having the developing device 130.

The process section, as shown in FIG. 20, mainly includes: the photoreceptor drum 2; the charging roller 3; the exposing means (not shown); the developing device 130; the transcription discharging roller 4; the cleaning means (not shown); the electricity removing means (not shown); and the fixing roller 5. Further, in FIG. 20, P refers to a recording paper, L refers to light beam which is irradiated from the exposing means so as to write an electrostatic latent image on a surface of the photoreceptor drum 2. Since operations of the process section is basically the same as operations described in Embodiment 2, detail descriptions are omitted here.

Next, how images are developed in the developing device 130 is detailed.

In the case where it is detected that toner runs out in the developing tank 132, the toner replenishing roller 137 provided in the hopper 131 rotates, so that uncharged toner is sent from the hopper 131 into the charging tank 133. As the toner replenishing roller 137, for example, a foaming urethane roller is used.

In the charging tank 133, the toner charging roller 138 and the cold cathode glass lamp 139 that constitute the toner charging means charge toner, and the toner is charged to such extent that images can be developed. That is, the cold cathode glass lamp 139 irradiates light to the electron emitting section formed on the toner charging roller 138, so that the electron emitting section induces photoelectrons in accordance with photoeffect. The photoelectrons are emitted to toner which passes through the charging tank 133, and the toner is charged to a desired charging amount. Note that, it is preferable that the cold cathode glass lamp 139 emits light in synchronism with the rotation of the toner replenishing roller 137 because emission of unnecessary light which increases power consumption can be restricted.

In the charging tank 133 having the foregoing arrangement, the toner charging means which is constituted of the toner charging roller 138 and the cold cathode glass lamp 139 emits electrons brought about by photoeffect to the toner which passes through the charging tank 133, so that the electrons are sprinkled over the toner. This causes the toner to be charged. Thus, it is possible to charge toner, passing through the charging tank 133, which is not in contact with the toner charging means. That is, it is possible to charge toner without giving any load to the toner.

Further, since the toner charging means is completely separated from the developing roller 113, surface roughness of the electron emitting section provided on the toner charging means does not influence a layer on which toner is formed. Thus, the toner charging means can charge toner without giving any load to the toner, and no restriction is given in designing the surface roughness of the electron emitting section.

Toner which is charged by the toner charging means of the charging tank 133 to a predetermined charging amount is sent to the developer tank 132. In the developer tank 132, as described above, the supplying roller 134 supplies toner sequentially to a surface of the developing roller 135, and the developing roller 135 rotates while carrying the toner. Thus, the toner transported by the developing roller 135 is guided to a space between the developing roller 135 and the contact area of the toner restricting blade 136, so that a layer thickness of the toner is restricted on the developing roller 135.

In this case, since the toner guided to a space between the developing roller 135 and the contact area of the toner restricting blade 136 has been charged in the charging tank 133, the toner restricting blade 136 is pressed to the developing roller 135 at least to such extent that the layer thickness of the toner can be restricted. Thus, it is possible to largely reduce pressure and thermal load given by the toner restricting blade 35 to the toner.

The toner formed on the developing roller 135 is sent to a portion opposite to the photoreceptor drum 2 in accordance with the rotation of the developing roller 135, and is electrostatically supplied to an electrostatic latent image formed on the surface of the photoreceptor drum 2, so that the electrostatic latent image is developed (visualized) as a toner image.

Next, a concrete arrangement of the toner charging means provided in the charging tank 133 is described with reference to FIG. 21(*a*) to FIG. 21(*c*).

Figure 21:
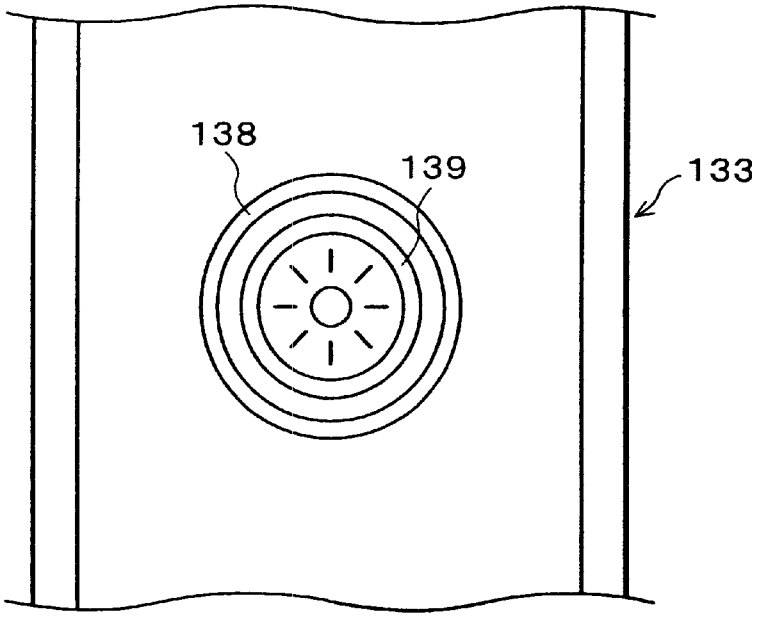
FIG. 21(*a*) and FIG. 21(*b*) show an arrangement of a toner restricting blade used in the developing device, and FIG. 21(*a*) is a cross sectional view of the toner charging means, and FIG. 21(*b*) is a plan view showing a state of a surface of the toner charging means, and FIG. 21(*c*) is a cross sectional view in D—D of FIG. 21(*a*).
Figure 21:
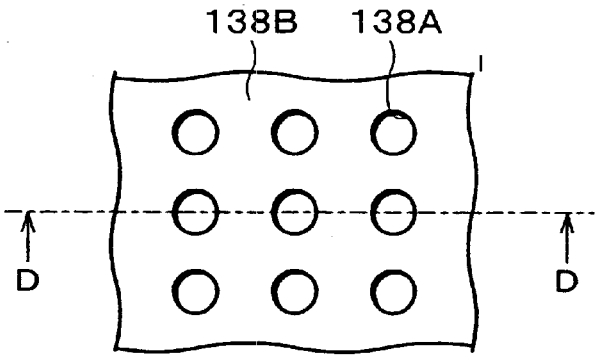
Figure 21:
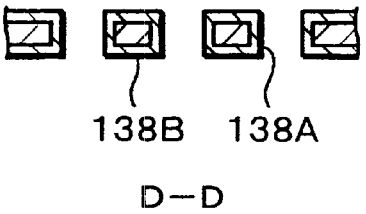

The toner charging means, as shown in FIG. 21(*a*), is provided in the charging tank 133, and is arranged so that the cold cathode glass lamp 139 is provided in the toner charging roller 138 having a cylindrical shape. Note that, the shape of the toner charging roller is not limited to a cylindrical shape, but may be a square cylinder etc.

In the toner charging roller 138, as a backing material, for example, a metallic cylinder of SUS (that is, conductive backing material) is used. At an area where the electron emitting section is formed, as shown in FIG. 21(*b*) and FIG. 21(*c*), plural openings 138A are formed in accordance with etching etc. Further, at an area where the electron emitting section is formed, a thin film of aluminium is laminated as a photoelectric surface 138B in accordance with, for example, deposition.

Note that, in Embodiment 6, descriptions are given on the supposition that the electron emitting section is formed on a whole outer surface of the toner charging roller 138, but the electron emitting section may be formed on a portion of the outer surface. For example, in a case where the electron emitting section is combined to a bias applying means as described in Embodiment 8, the electron emitting section may be formed only on an area where the bias is applied (area opposite to an electrode plate).

According to FIG. 21(*b*), the openings 138A are made up of many small circular holes, but the shape of the openings 138A is not particularly limited in the present invention; the shape of the openings 138A may be a square or a triangle, or the openings 138A may be formed in a slit manner.

Further, material of which the photoelectric surface 138B is made is not limited to the above-mentioned aluminium, but may be metal such as Ta, alloy such as Mg—Ag, semiconductor, and conductive polymer as long as photoeffect is brought about upon receiving light irradiation. It is not necessary that the photoelectric surface 138B is formed on both sides of the toner charging roller 138 as shown in FIG. 21(*c*), but the photoelectric surface 138B is formed at least on a side opposite to the cold cathode glass lamp 139 (that is, on the side of an inner surface of the toner charging roller 138).

As light which is irradiated to the electron emitting section of the toner charging roller 138, a visible ray, ultraviolet, or an X ray can be used as long as the light has such a wavelength that can bring about photoeffect with respect to material of which the photoelectric surface 138B is made.

In a case where toner is charged by the toner charging means of the foregoing arrangement, the cold cathode glass lamp 139 emits light, so that the light is emitted from the inside of the toner charging roller 138 to the electron emitting section formed on the toner charging roller 138. Thus, photoelectrons brought about in accordance with photoeffect are induced in the electron emitting section of the toner charging roller 138. A part of the photoelectrons brought about in this manner passes through the openings 138A of the electron emitting section so as to be irradiated from the outer surface of the toner charging roller 138. This contributes to charging of toner.

Further, it is easily understood that: when the electron emitting section is electrically under a float condition, the photoelectric surface 138B of the electron emitting section cannot continue to irradiate photoelectrons. Thus, it is required to arrange the electron emitting section so that as many electrons as electrons emitted from the photoelectric surface 138B can be supplied from the outside. Here, the electron emitting section is formed by depositing an aluminium thin film as the photoelectric surface 138B on a backing material of the toner charging roller 138 which is constituted of SUS, so that it is possible to easily realize the foregoing arrangement by grounding the backing material of the toner charging roller 138.

In the developing device 130 according to Embodiment 6, a relationship between pressure of the toner restricting blade 136 and a charging characteristic of toner is substantially similar to the relationship shown in FIG. 16 of Embodiment 3. In this case, a patterning condition of the openings 138A of the electron emitting section is that aperture ratio is 40% and a hole shape of the opening 138A is $\phi 200\ \mu m$. The cold cathode glass lamp 139 irradiates ultraviolet having a 254 nm wavelength. However, in this case, an electric bias of $5\times10^{-6}$V/m is applied between the toner charging roller 138 and the electrode plate 42 (see FIG. 15) in accordance with Embodiment 8 described later.

FIG. 16 shows that pressure of about 196 kPa is required to obtain the desired charging amount in a friction charging method of the prior art. On the other hand, according to the friction charging method of the present invention, the desired charging amount can be obtained by a quarter of pressure required in the friction charging method of the prior art, that is, by pressure of about 49 kPa.

As described above, the developing device 130 according to Embodiment 6 can largely reduce pressure of the toner restricting blade 136 compared with a developing device using a conventional friction charging method. Thus, pressure and thermal load given to toner by the toner restricting blade 136 are largely reduced, so that it is possible to avoid such defect that toner is damaged or toner is fused and adheres to the toner restricting blade 136.

Note that, in the developing device 130, the toner charging means is provided in the charging tank 133 provided between the hopper 131 and the developer tank 132, but a position where the toner charging means is provided is not limited to this. That is, as long as the toner charging means can charge toner whose layer has not been formed on the developing roller 135, the toner charging means may be arbitrary provided on any position in the developing device 130. Concretely, as long as the toner charging means is provided on the upstream side with respect to the supplying roller 134, it is possible to charge toner whose layer has not been formed on the developing roller 135.

If toner charged by the toner charging means has not form a toner layer on the developing roller 135, the toner is stirred while forming the toner layer, so that the charging amount of the toner is uniformed on the developing roller 135.

Further, in the developing device according to Embodiment 6, the toner charging means is provided in the charging tank 133 provided between the hopper 131 and the developer tank 132. According to the arrangement, toner which falls down while floating in the developing device is charged.

In this case, since the toner charged by the toner charging means is under a comparatively scattered condition (density is low), the toner charging means can charge the falling toner uniformly, so that the ultimate uniformity of the charging amount of toner is improved.

As described above, in the developing device according to Embodiment 6, the developer charging means charges the developer, which has not been provided as a layer on the developer support body, under a condition that the developer is less coagulated in the developing device.

According to the foregoing arrangement, the developer charging means charges developer under a condition that the developer is less coagulated in the developing device, so that it becomes easier for electrons to adhere to particles of the developer. Thus, it is possible to improve the uniformity in charging the developer.

Alternately, the developing device can be regarded have the following arrangement: the developer charging means is provided on the upstream side with respect to the developer supplying means for supplying the developer to a surface of the developer support body.

According to the foregoing arrangement, the developer charging means charges the developer on the upstream side with respect to the developer supplying means, so that the charged developer is stirred by actions of the developer supplying means, the developer support body, and the layer thickness restricting blade which are provided on the downstream side with respect to the developer charging means. Thus, it is possible to improve the ultimate uniformity in charging the developer.

Further, the developing device includes (a) a hopper for storing the developer that has not been charged, and (b) a developer tank, provided on a downstream side with respect to the hopper, which receives the developer supplied from the hopper, and the developer charging means, provided between the hopper and the developer tank, which charges the developer falling from the hopper so as to be supplied to the developer tank.

According to the foregoing arrangement, the developer charging means charges the developer which falls from the hopper so as to be supplied to the developer tank. Thus, the developer which is to be charged is less coagulated, so that it is easier for electrons to adhere to particles of the developer. As a result, it is possible to improve the uniformity in charging the developer. Further, the charged developer is stirred by actions of the developer supplying means, the developer support body, and the layer thickness restricting blade. Thus, it is possible to improve the ultimate uniformity in charging the developer.

Further, it is preferable that the developing device is arranged so that he developer charging means includes: a charging member of a cylindrical shape which has an area where the electron emitting section is provided; and the light irradiating means, provided in the charging member, which can irradiate light in all directions.

According to the foregoing arrangement, the light irradiated from the light irradiating means can be irradiated to the electron emitting section which is widely provided on the charging member, so that it is possible to improve the utility efficiency of the irradiated light.

Further, the developing device can be arranged so that the charging member has an opening on an area which serves as the electron emitting section, and a photoelectric film, which emits the electrons upon receiving the light irradiated from the light irradiating means, is provided at least on an inner surface of the charging member, the inner surface being a portion of the area which serves as the electron emitting section.

According to the foregoing arrangement, the electrons, which have been brought about in the photoelectric film by the light irradiated from the light irradiating means, pass through the opening so as to be emitted from an outer surface of the charging member. Thus, it is possible to charge the developer which passes outside the charging member.

Further, in the developing device, the developer charging means can be arranged so that a photoelectric film, which emits electrons upon receiving the light irradiated from the light irradiating means, is provided on an outer surface of the light irradiating means which can irradiate light in all directions.

According to the foregoing arrangement, the light irradiated from the light irradiating means directly reaches the photoelectric film, and photoelectrons which have been brought about are emitted from the outer surface of the charging member. Thus, it is possible to charge the developer which passes outside the charging member. Further, the photoelectric film is provided on the outer surface of the light irradiating means, so that it is possible to reduce the number of members in the developer charging means.

[Embodiment 7]

Still another embodiment of the present invention is described based on drawings as follows.

Figure 22:
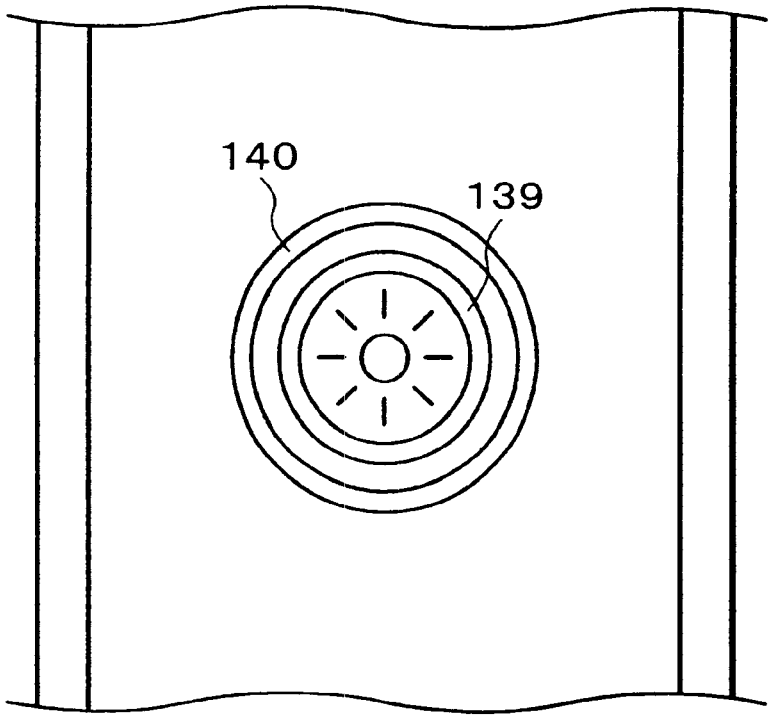
FIG. 22(*a*) and FIG. 22(*b*) show an arrangement of toner charging means used in a developing device according to Embodiment 7 of the present invention, and FIG. 22(*a*) is a cross sectional view of the toner charging means and FIG. 22(*b*) is a cross sectional view in the vicinity of a surface of the toner charging means.
Figure 22:
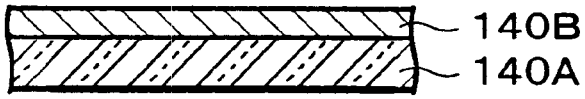

A developing device according to Embodiment 7 is arranged so that a toner charging roller 140 as shown in FIG. 22(*a*) to FIG. 22(*c*) is used instead of the toner charging roller 138 described in Embodiment 6. That is, the toner charging means, as shown in FIG. 22(*a*), is arranged so that the cold cathode glass lamp 139 is provided in a toner charging roller 140 having a cylindrical shape.

The toner charging roller 140 is arranged so that, as shown in FIG. 22(*b*), a cylindrical transparent backing material 140A such as glass, fused quartz, and acrylate resin is used, and a metallic thin film is formed as an electron emitting section 140B on the side of an outer surface of the transparent backing material 140A. Of course, material of which the electron emitting section 140B is made is not limited as long as photoeffect is brought about upon receiving light irradiation, so that the material may be, for example, metal such as Al or Ta, alloy such as Mg—Ag, semiconductor, and conductive polymer.

In the toner charging means, light irradiated from the cold cathode glass lamp 139 is irradiated from the side of the inner surface of the toner charging roller 140 to the toner charging roller 140. The light passes through the transparent backing material 140A of the toner charging roller 140 and arrives at the electron emitting section 140B.

Here, unlike the electron emitting section of the toner charging roller 138, the electron emitting section 140B does not include the openings 138A. That is, the electron emitting section 140 is constituted only of a metallic thin film which acts as a photoelectric surface.

Note that, in the toner charging roller 140 of the foregoing arrangement, since photoelectrons which are emitted from the electron emitting section 140B having no opening 138A are emitted from the side of the outer surface of the toner charging roller 140 as in the above-mentioned electron emitting section 124 of Embodiment 5, detail descriptions are omitted. Further, it is preferable that, like the electron emitting section 124 described in Embodiment 5, a film thickness of the metallic thin film (aluminium film) constituting the electron emitting section 140B is set most suitably so that its transmittance is 40 to 70%.

Figure 23:
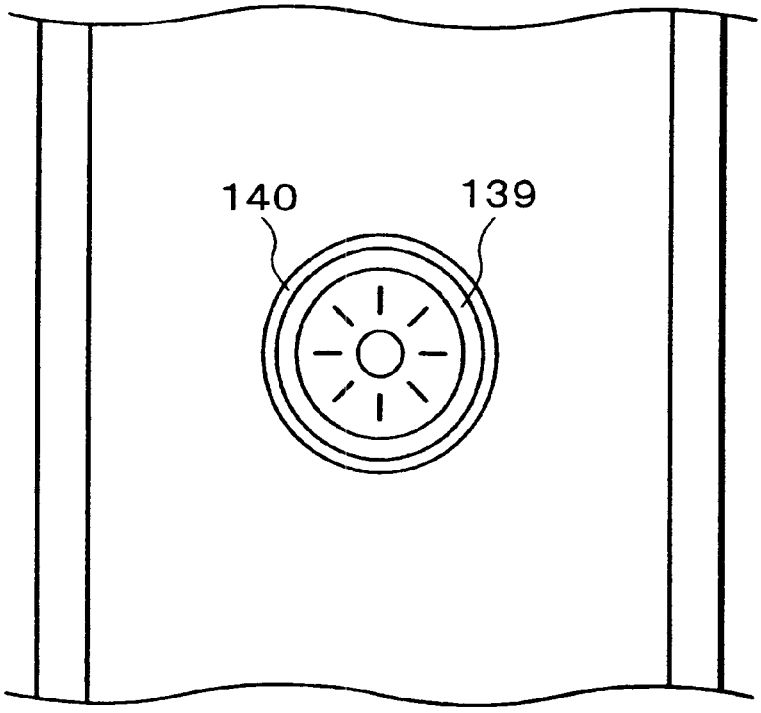
FIG. 23(*a*) and FIG. 23(*b*) show an arrangement of another toner charging means used in the developing device according to Embodiment 7 of the present invention, and FIG. 23(*a*) is a cross sectional view of the toner charging means and FIG. 23(*b*) is a cross sectional view in the vicinity of a surface of the toner charging means.
Figure 23:
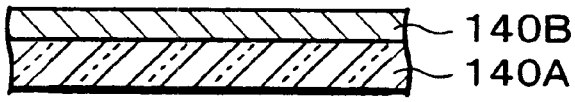

Further, in order to realize low cost in the toner charging means, an arrangement shown in FIG. 23(*a*) and FIG. 23(*b*) can be applied. The toner charging means in this case, as shown in FIG. 23(*a*), is arranged so that the metallic thin film which serves as the electron emitting section 141 is directly formed on the outer surface of the cold cathode glass lamp 139. That is, as shown in FIG. 23(*b*), the metallic thin film which serves as the electron emitting section 141 is directly formed on a surface of a glass tube 139A of the cold cathode glass lamp 139. The arrangement does not require the transparent backing material 140A of the toner charging roller 140, so that the number of members can be reduced. As a result, it is possible to realize reduction in cost.

Of course, like the electron emitting section 140B of the toner charging roller 140, material of which the electron emitting section 141 is made may be, for example, metal such as Al or Ta, alloy such as Mg—Ag, semiconductor, and conductive polymer. Further, it is preferable that a film thickness of the electron emitting section 141 is set most suitably so that its transmittance is 40 to 70%.

In the arrangement of the developing device according to Embodiment 7 (arrangement shown in FIG. 22(*a*) and FIG. 22(*b*), or FIG. 23(*a*) and FIG. 23(*b*)), a relationship between pressure given by the toner restricting blade 136 and a charging characteristic of toner is substantially similar to the relationship shown in FIG. 16 of Embodiment 2. In this case, the cold cathode glass lamp 139 irradiates ultraviolet having a 254 nm wavelength.

FIG. 16 shows that pressure of about 196 kPa is required to obtain the desired charging amount ($-2.0\times10^{-2}$ C/kg) in a friction charging method of the prior art. On the other hand, according to the friction charging method of the present invention, the desired charging amount can be obtained by a quarter of pressure required in the friction charging method of the prior art, that is, by pressure of about 49 kPa.

As described above, in the developing device according to Embodiment 7, the charging member is arranged so that the charging member has a photoelectric film, which emits electrons upon receiving light irradiated from the light irradiating means, on an outer surface of a cylindrical backing material having light transmittance.

According to the foregoing arrangement, the light irradiated from the light irradiating means passes through the cylindrical backing material so as to reach the photoelectric film, and photoelectrons which have been brought about by photoeffect are emitted from the outer surface of the charging member. Thus, it is possible to charge the developer which passes outside the charging member.

[Embodiment 8]

Still another embodiment of the present invention is described based on drawings as follows.

Figure 24:
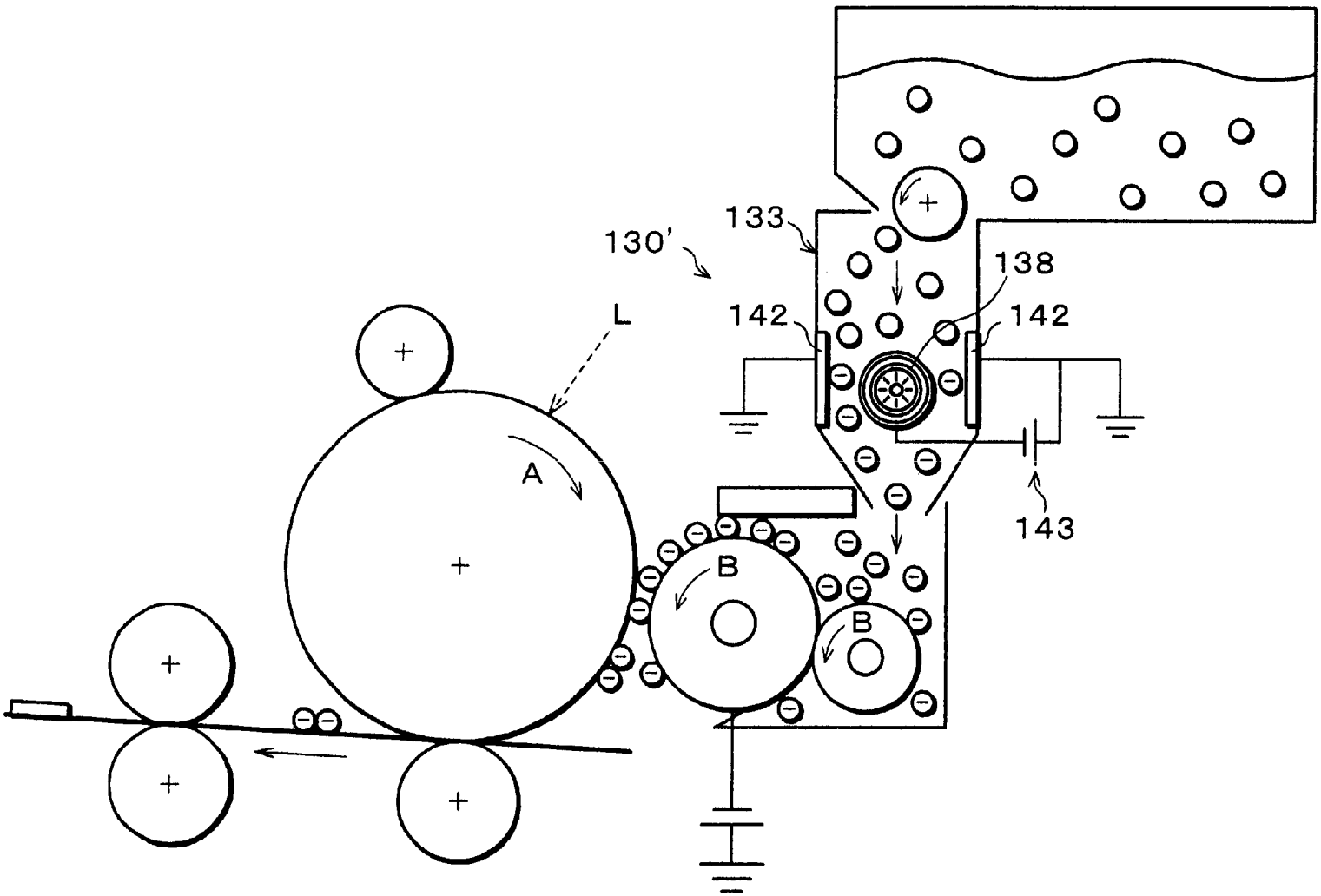
FIG. 24 is a cross sectional view showing a schematic arrangement of a developing device according to Embodiment 8 of the present invention.

A developing device 130' according to Embodiment 8, as shown in FIG. 24, is arranged so that an electrode plate 142 is provided on an internal side wall of the charging tank 133, and the toner charging roller 138 and the electrode plate 142 are connected to a bias applying means 143, so that an electric bias is applied between the toner charging roller 138 and the electrode plate 142. Other than this arrangement, the developing device 130' is arranged in the same manner as the developing device 130.

In the developing device 130' of the foregoing arrangement, an electric bias is applied between the toner charging roller 138 and the electrode plate 142, so that it is possible to improve the charging effect in the toner charging means due to an action as described in Embodiment 3. That is, an electric field brought about by applying the electric bias causes an action which heightens a utility rate of photoelectrons emitted from the electron emitting section and an action of electric avalanche to improve the charging efficiency.

Figure 25:
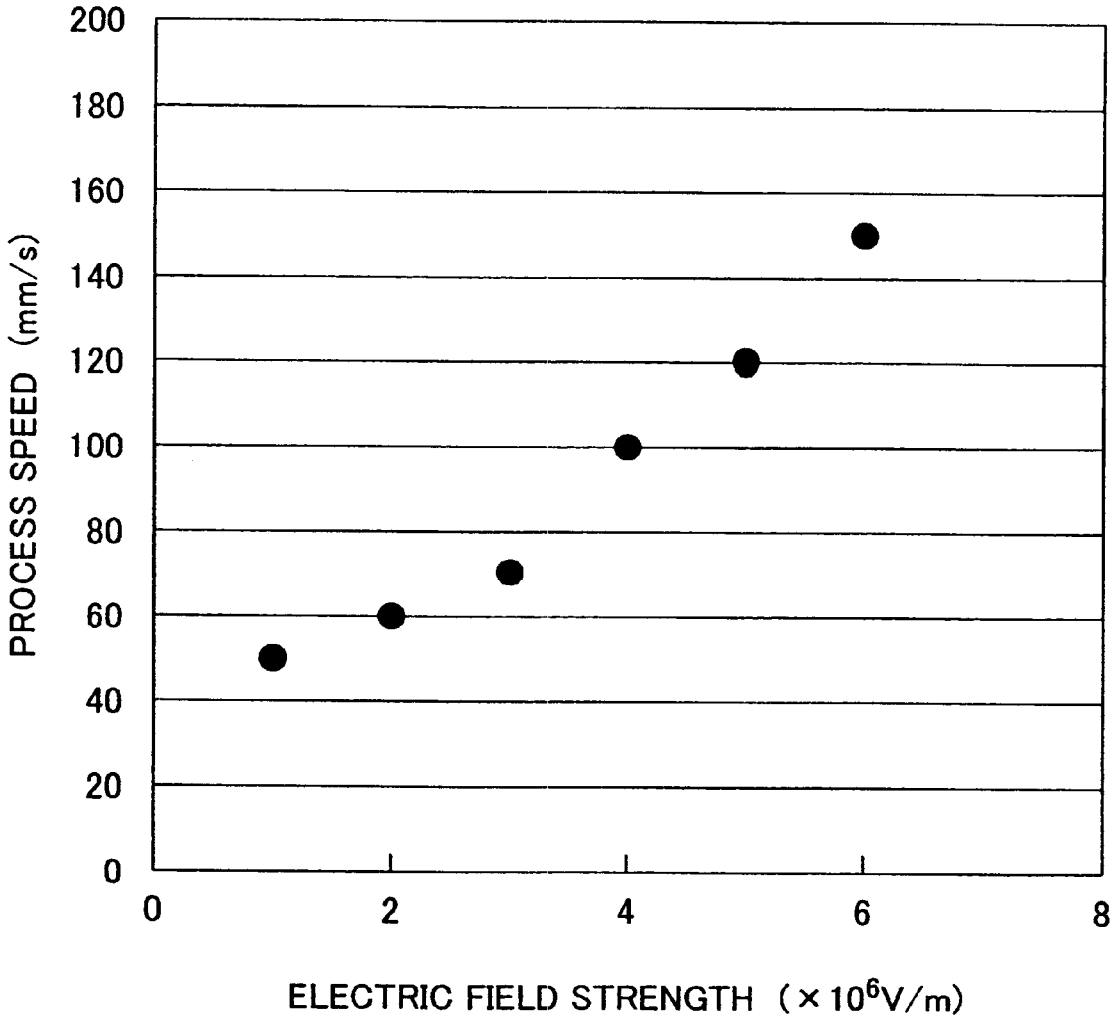
FIG. 25 is a graph showing how electric field strength of an electric bias applied between an electron emitting section of the developing device and an electrode plate provided opposite to the electron emitting section relates to a process speed at which images can be formed.

Here, the electric bias between the toner charging roller 138 and the electrode plate 142 are applied so that the electric field strength is in a range of 0.5 to $2.5\times10^6$ (V/m) FIG. 25 shows a relationship between the electric field strength, at which the desired charging amount ($-2.0\times10^{-2}$ $\mu$C/kg) is obtained, and a process speed in this case. It is obvious from FIG. 25 that in the case where the process speed at which the desired charging amount is obtained is also improved by increasing the electric field strength of the electric bias and the electric bias in the foregoing range is applied, it is possible to charge toner to such extent that the process speed is 50 to 150 mm/s.

Note that, in the foregoing description, although the developing device 130' is arranged so that the electrode plate 142 and the bias applying means 143 are combined to the toner charging means shown in FIG. 21, it is also possible to combine the electrode plate 142 and the bias applying means 143 to the toner charging means shown in FIG. 22 or FIG. 23. Here, in the case where the electrode plate 142 and the bias applying means 143 to the toner charging means shown in FIG. 21, it is possible to connect the bias applying means 143 to a backing material of the toner charging roller 138.

While, in the case where the electrode plate 142 and the bias applying means 143 are combined to the toner charging means shown in FIG. 22(*a*) and FIG. 22(*b*), or FIG. 23(*a*) and FIG. 23(*b*), the bias applying means 143 is directly connected to the electron emitting section 140B of the toner charging roller 140 or the electron emitting section 141 formed on a surface of the cold cathode glass lamp 139. Alternately, a transparent conductive layer made of, for example, ITO (Indium Tin Oxide) is formed on the electron emitting section 140B or a lower layer of the electron emitting section 141, and the bias applying means 143 is connected to the electron emitting section 140B or the electron emitting section 141 via the transparent conductive layer.

As described above, the developing device according to Embodiment 8 includes an electrode plate opposite to at least one portion of the electron emitting section; and bias applying means for applying an electric bias between the electron emitting section and the electrode plate.

According to the arrangement, photoelectrons emitted from the photoelectric film of the electron emitting section are attracted to developer by the bias, so that it is possible to give more electrons to the developer which passes through an external portion of the charging member (more concretely, between the electron emitting section and the electrode plate). Further, the attracted electrons are accelerated so as to bring about electric avalanche, so that it is possible to amplify electrons which contribute to charging of toner. Thus, it is possible to obtain high charging efficiency.

Note that, in the descriptions of the respective embodiments, although descriptions are given as to the case where the nonmagnetic 1 component toner is used as toner, toner which can be used in the developing device of the present invention is not limited to the nonmagnetic 1 component toner, but magnetic toner or 2 component toner may be used. However, the developing device of the present invention is to reduce thermal load given to toner so as to prevent the toner from being damaged or from fusing and adhering to a blade, and it is possible to obtain a preferable effect in the case where the developing device of the present invention is applied particularly to the nonmagnetic 1 component toner which raises such a problem that toner is fused and adheres to a blade.

In the descriptions of the respective embodiments, toner is charged by the toner charging means which is a main characteristic arrangement of the present invention, and pressure of the toner restricting blade exerted to the developing roller is set to be minimum pressure which is required in restricting a layer thickness of the toner.

However, the developing device of the present invention is not limited to this arrangement, but the toner charging means may be in auxiliary use upon charging toner. That is, in this case, pressure of the toner restricting blade exerted to the developing roller is set to be the strongest under a condition that toner is not damaged or the toner does not adhere to a blade, and the toner charging means of the present invention charges a voltage whose value is equal to a shortage brought about between a charging amount in accordance with the friction charging and the desired charging amount.

According to the arrangement in which the toner charging means is in auxiliary use upon charging toner, it is possible to set charging performance required in the toner charging means to be small, so that it is possible to realize reduction in cost of the toner charging means.

Note that, in a relationship between the charging performance of the toner charging means and the pressure of the toner restricting blade of the developing roller, a total charging amount of a toner charging amount based on the toner charging means and a toner charging amount based on the friction charging reaches the desired charging amount which is ultimately required. That is, it is possible to arbitrarily set a ratio of (a) the toner charging amount based on the toner charging means and (b) the toner charging amount based on the friction charging under a condition that toner is not damaged or the toner does not adhere to a blade.

Further, the light irradiating means of the present invention is not limited to the ultraviolet irradiater 116 or the cold cathode glass lamp 139 used in the respective embodiments, but there is not limitation with respect to the light irradiating means as long as it is possible to irradiate light which can induce photoeffect. However, it is preferable that the light irradiating means is a light source which generates less heat, and a xenon lamp etc. can be preferably used other than the ultraviolet irradiater and the cold cathode glass lamp.

Further, although the electron emitting section of the respective embodiments obtains the emitted electrons to charge toner in accordance with photoeffect, in principle, it is possible to use thermoelectric effect (thermionic emission) in which the electron emitting section is heated so as to emit electrons. However, the developing device of the present invention is to reduce thermal load given to toner, so that it is needless to say that it is more preferable that photoeffect emitting no heat is used.

As described above, in the developing device according to Embodiments 1 to 8, it is preferable that: the developer charging means includes the light irradiating means, and the light irradiating means irradiates light to the electron emitting section, so that electrons are emitted in accordance with photoeffect.

According to the arrangement, the developer charging means can emit electrons to developer without giving thermal load.

Further, in the developing device according to Embodiments 1 to 8, it is possible to obtain a particularly preferable effect by applying the present invention to a charging operation with respect to nonmagnetic 1 component toner which is liable to fuse and adhere to a blade.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A developing device, which is used in an electrophotographic apparatus to develop an electrostatic latent image on a latent image support body by developer that has been charged, comprising:

transport means for supporting the developer so as to transport the developer to the latent image support body; and charging means which includes (a) an electron inducing section for inducing its electrons by receiving light irradiation and (b) irradiating means for irradiating light to the electron inducing section, and gives the electrons to the developer so as to charge the developer, wherein the charging means and the transport means have a space therebetween, and a grid electrode for controlling a flow of the electrons is provided in the space.

2. The developing device as set forth in claim 1, wherein the developer is negatively charged, and an absolute value of a charging amount is not less than 5 $\mu$c/g and not more than 30 $\mu$c/g.

3. The developing device as set forth in claim 1, wherein a voltage, whose value is equal to a total of (a) a value of a voltage applied to the transport means and (b) a value of a voltage for charging the developer, is applied to the grid electrode.

4. The developing device as set forth in claim 1, wherein the electron inducing section is made of semiconductor or metal.

5. The developing device as set forth in claim 1, wherein a bias voltage is applied between the electron inducing section and the transport means.

6. The developing device as set forth in claim 1, wherein:

(a) supplying means for supplying the developer to the transport means and (b) the charging means are provided in this order along a direction in which the developer is transported, the supplying means and the charging means being opposite to the transport means, and the supplying means restricts a thickness of the developer transported on the transport means to a fixed thickness.

7. The developing device as set forth in claim 1, wherein voltages having same polarities are applied to the charging means, the grid electrode, and the transport means respectively, and the voltages satisfy a relationship of a voltage applied to the charging means>a voltage applied to the grid electrode>a voltage applied to the transport means.

8. The developing device as set forth in claim 1, wherein the developer is toner of 1 component system.

9. The developing device as set forth in claim 1, wherein wavelength changing means for changing a wavelength of the light irradiated from the irradiating means is provided between the electron inducing section and the irradiating means for irradiating the light to the electron inducing section.

10. The developing device as set forth in claim 1, wherein the irradiating means is provided opposite to the transport means with the electron inducing section therebetween.

11. A developing device, which is used in an electrophotographic apparatus to develop an electrostatic latent image on a latent image support body by developer that has been charged, comprising:

a developer support body for supporting the developer so as to transport the developer to the latent image support body; and developer charging means for charging the developer, wherein the developer charging means is provided so as to be separated from the developer support body and is provided with an electron emitting section which can emit electrons toward the developer which is to be charged, and the developer charging means charges the developer by sprinkling the electrons, that have been emitted from the electron emitting section, over the developer.

12. The developing device as set forth in claim 11, wherein:

the developer charging means includes light irradiating means, and the electron emitting section receives light irradiated from the light irradiating means, so as to emit electrons in accordance with photoeffect.

13. The developing device as set forth in claim 11, wherein: the electron emitting section is provided on an area other than a contact area of a layer thickness restricting blade for restricting a layer thickness of the developer which is provided as a layer on the developer support body, the contact area being in contact with the developer support body.

14. The developing device as set forth in claim 13, wherein:

the light irradiating means is provided opposite to one side of the layer thickness restricting blade, an other side of the layer thickness restricting blade being opposite to the developer support body, and the layer thickness restricting blade includes an opening on an area which serves as the electron emitting section, and the area which serves as the electron emitting section has a photoelectric film, which emits the electrons upon receiving the light irradiated from the light irradiating means, at least on said one side opposite to the light irradiating means.

15. The developing device as set forth in claim 14, wherein:

the opening has a slope so that (opening area on a light irradiating side)>(opening area on a side where the electrons are emitted), and the electron emitting section has the photoelectric film at least on said one side opposite to the light irradiating means and on an inner portion of the opening.

16. The developing device as set forth in claim 13, wherein:

the light irradiating means is provided opposite to one side of the layer thickness restricting blade, an other side of the layer thickness restricting blade being in contact with the developer support body, and the layer thickness restricting blade includes a photoelectric film, which emits electrons upon receiving the light irradiated from the light irradiating means, on an area which serves as the electron emitting section made of a backing material having light transmittance, said area being said other side opposite to the developer support body.

17. The developing device as set forth in claim 13, wherein:

the layer thickness restricting blade is insulated against the developer support body, and the developer charging means includes bias applying means for applying an electric bias between the layer thickness restricting blade and the developer support body.

18. The developing device as set forth in claim 11, wherein the developer charging means charges the developer, which has not been provided as a layer on the developer support body, under a condition that the developer is less coagulated in the developing device.

19. The developing device as set forth in claim 11, wherein the developer charging means is provided on an upstream side with respect to developer supplying means for supplying the developer to a surface of the developer support body.

20. The developing device as set forth in claim 11, wherein:

the developing device includes (a) a hopper for storing the developer that has not been charged, and (b) a developer tank, provided on a downstream side with respect to the hopper, which receives the developer supplied from the hopper, and the developer charging means, provided between the hopper and the developer tank, which charges the developer falling from the hopper so as to be supplied to the developer tank.

21. The developing device as set forth in claim 18, wherein the developer charging means includes:

a charging member of a cylindrical shape which has an area where the electron emitting section is provided; and the light irradiating means, provided in the charging member, which can irradiate light in all directions.

22. The developing device as set forth in claim 19, wherein the developer charging means includes:

a charging member of a cylindrical shape which has an area where the electron emitting section is provided; and the light irradiating means, provided in the charging member, which can irradiate light in all directions.

23. The developing device as set forth in claim 20, wherein the developer charging means includes:

a charging member of a cylindrical shape which has an area where the electron emitting section is provided; and the light irradiating means, provided in the charging member, which can irradiate light in all directions.

24. The developing device as set forth in claim 21, wherein the charging member has an opening on an area which serves as the electron emitting section, and a photoelectric film, which emits the electrons upon receiving the light irradiated from the light irradiating means, is provided at least on an inner surface of the charging member, the inner surface being a portion of the area which serves as the electron emitting section.

25. The developing device as set forth in claim 22, wherein the charging member has an opening on an area which serves as the electron emitting section, and a photoelectric film, which emits the electrons upon receiving the light irradiated from the light irradiating means, is provided at least on an inner surface of the charging member, the inner surface being a portion of the area which serves as the electron emitting section.

26. The developing device as set forth in claim 23, wherein the charging member has an opening on an area which serves as the electron emitting section, and a photoelectric film, which emits the electrons upon receiving the light irradiated from the light irradiating means, is provided at least on an inner surface of the charging member, the inner surface being a portion of the area which serves as the electron emitting section.

27. The developing device as set forth in claim 21, wherein the charging member has a photoelectric film, which emits the electrons upon receiving light irradiated from the light irradiating means, on an outer surface of a cylindrical backing material having light transmittance.

28. The developing device as set forth in claim 22, wherein the charging member has a photoelectric film, which emits the electrons upon receiving light irradiated from the light irradiating means, on an outer surface of a cylindrical backing material having light transmittance.

29. The developing device as set forth in claim 23, wherein the charging member has a photoelectric film, which emits the electrons upon receiving light irradiated from the light irradiating means, on an outer surface of a cylindrical backing material having light transmittance.

30. The developing device as set forth in claim 18, wherein the developer charging means has a photoelectric film, which emits the electrons upon receiving light irradiated from the light irradiating means, on an outer surface of the light irradiating means which can irradiate light in all directions.

31. The developing device as set forth in claim 19, wherein the developer charging means has a photoelectric film, which emits the electrons upon receiving light irradiated from the light irradiating means, on an outer surface of the light irradiating means which can irradiate the light in all directions.

32. The developing device as set forth in claim 20, wherein the developer charging means has a photoelectric film, which emits the electrons upon receiving light irradiated from the light irradiating means, on an outer surface of the light irradiating means which can irradiated the light in all directions.

33. The developing device as set forth in claim 21, further comprising:

an electrode plate provided opposite to at least one portion of the electron emitting section; and bias applying means for applying an electric bias between the electron emitting section and the electrode plate.

34. The developing device as set forth in claim 22, further comprising:

an electrode plate provided opposite to at least one portion of the electron emitting section; and bias applying means for applying an electric bias between the electron emitting section and the electrode plate.

35. The developing device as set forth in claim 23, further comprising:

an electrode plate provided opposite to at least one portion of the electron emitting section; and bias applying means for applying an electric bias between the electron emitting section and the electrode plate.

36. The developing device as set forth in claim 30, further comprising:

an electrode plate provided opposite to at least one portion of the electron emitting section; and bias applying means for applying an electric bias between the electron emitting section and the electrode plate.

37. The developing device as set forth in claim 31, further comprising:

an electrode plate provided opposite to at least one portion of the electron emitting section; and bias applying means for applying an electric bias between the electron emitting section and the electrode plate.

38. The developing device as set forth in claim 32, further comprising:

an electrode plate provided opposite to at least one portion of the electron emitting section; and bias applying means for applying an electric bias between the electron emitting section and the electrode plate.

39. The developing device as set forth in claim 11, wherein the developer is nonmagnetic 1 component toner.

40. A charging method for charging developer whereby an electrostatic latent image is developed into a visualized image, wherein light is irradiated to an electron inducing material which induces its electrons by receiving the light that has been irradiated, and the electrons that have been induced are emitted to the developer via a grid electrode so as to charge the developer.

41. A charging method for charging developer used in a developing device which develops an electrostatic latent image formed on a latent image support body of an electrophotographic apparatus by charged developer used in the electrophotographic apparatus, wherein:

light is irradiated to an electron emitting section provided so as to be separated from a developer support body which transports the developer to the latent image support body, and electrons which have been emitted from the electron emitting section in accordance with photoeffect caused by the irradiated light are sprinkled over the developer, so as to charge the developer.

42. The charging method as set forth in claim 41, wherein the electrons emitted from the electron emitting section are accelerated by an electric bias, and an electric avalanche is brought about so as to amplify the electrons that make contribution in charging the developer.

43. A printing apparatus comprising: a latent image support body for supporting an electrostatic latent image formed in accordance with an image signal; and a developing device for developing the electrostatic latent image, wherein:

the developing device includes:

transport means for supporting developer so as to transport the developer to the latent image support body; and charging means which has (a) an electron inducing section for inducing its electrons by receiving light irradiation and (b) irradiating means for irradiating light to the electron inducing section, and gives the electrons to the developer so as to charge the developer, and the charging means and the transport means have a space therebetween, and a grid electrode for controlling a flow of the electrons is provided in the space.

44. A printing apparatus comprising: a latent image support body for supporting an electrostatic latent image formed in accordance with an image signal; and a developing device for developing the electrostatic latent image, wherein:

the developing device includes:

a developer support body for supporting developer so as to transport the developer to the latent image support body; and developer charging means for charging the developer, and the developer charging means is provided so as to be separated from the developer support body and is provided with an electron emitting section which can emit electrons toward the developer which is to be charged, and the developer charging means charges the developer by sprinkling the electrons, that have been emitted from the electron emitting section, over the developer.

* * * * *